US011781367B2

(12) United States Patent
Choi

(10) Patent No.: US 11,781,367 B2
(45) Date of Patent: Oct. 10, 2023

(54) VEHICLE DOOR OPENING AND CLOSING APPARATUS

(71) Applicants: Hyundai Motor Company, Seoul (KR); Kia Motors Corporation, Seoul (KR)

(72) Inventor: Je Won Choi, Anyang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 327 days.

(21) Appl. No.: 17/014,351

(22) Filed: Sep. 8, 2020

(65) Prior Publication Data

US 2021/0172237 A1 Jun. 10, 2021

(30) Foreign Application Priority Data

Dec. 10, 2019 (KR) ..... 10-2019-0164177

(51) Int. Cl.

| | |
|---|---|
| ***E05F 11/00*** | (2006.01) |
| ***E05F 15/638*** | (2015.01) |
| ***E05F 15/619*** | (2015.01) |
| ***E05F 15/655*** | (2015.01) |

(52) U.S. Cl.

CPC ..... *E05F 15/638* (2015.01); *E05F 15/619* (2015.01); *E05F 15/655* (2015.01); *E05Y 2201/684* (2013.01); *E05Y 2201/688* (2013.01); *E05Y 2201/716* (2013.01); *E05Y 2201/722* (2013.01); *E05Y 2600/622* (2013.01);

(Continued)

(58) Field of Classification Search

CPC ..... E05F 15/638; E05F 15/619; E05F 15/655; E05Y 2201/22; E05Y 2201/224; E05Y 2201/41; E05Y 2201/422; E05Y 2201/626; E05Y 2201/684; E05Y 2201/688; E05Y 2201/716; E05Y 2201/722; E05Y 2800/102; E05Y 2900/531; E05B 81/16

USPC ..... 49/254, 257, 258, 259, 360

See application file for complete search history.

(56) References Cited

U.S. PATENT DOCUMENTS 5,992,097 A * 11/1999 Makiuchi ..... E05D 15/0691 49/216
7,669,367 B2 * 3/2010 Shimura ..... E05D 15/1047 49/213
11,472,271 B2 * 10/2022 Choi ..... B60J 5/06

(Continued)

FOREIGN PATENT DOCUMENTS

CN 105984310 A * 10/2016 ..... B60J 5/047
CN 115003530 A * 9/2022 ..... E05D 15/0665

(Continued)

*Primary Examiner* — Jerry E Redman
(74) *Attorney, Agent, or Firm* — Slater Matsil, LLP

(57) ABSTRACT

A vehicle includes a vehicle body having a door frame defining a door aperture, a vehicle door, a rail mounted on the vehicle body, a roller unit mounted on the vehicle door and configured to move along the rail and allow the vehicle door to open and close in a sliding mode and a swing mode, a center rail extending from an edge of the door aperture, and a center roller unit including rollers configured to be guided along the center rail, a roller bracket having the rollers mounted thereon, a roller-side hinge element connected to the roller bracket, and a door-side hinge element rotatably connected to the roller-side hinge element, wherein the roller-side hinge element and the door-side hinge element are releasably connected.

20 Claims, 37 Drawing Sheets

(52) U.S. Cl.
CPC ..... *E05Y 2600/626* (2013.01); *E05Y 2800/102* (2013.01); *E05Y 2900/531* (2013.01)

(56) References Cited

U.S. PATENT DOCUMENTS

| | | | | |
|---|---|---|---|---|
| 11,512,515 | B2 * | 11/2022 | Choi | B60J 5/0473 |
| 2012/0036781 | A1 * | 2/2012 | Runk | E05C 17/28 49/181 |
| 2018/0119465 | A1 * | 5/2018 | Wojdyla | E05D 3/04 |
| 2021/0079703 | A1 * | 3/2021 | Yun | E05D 15/30 |
| 2021/0140215 | A1 * | 5/2021 | Choi | E05B 83/38 |
| 2021/0140216 | A1 * | 5/2021 | Choi | E05D 15/1042 |
| 2021/0170839 | A1 * | 6/2021 | Choi | E05D 15/0604 |
| 2021/0170842 | A1 * | 6/2021 | Choi | E05D 15/1047 |
| 2021/0172235 | A1 * | 6/2021 | Choi | E05F 15/619 |
| 2021/0172236 | A1 * | 6/2021 | Choi | E05F 15/619 |
| 2021/0172237 | A1 * | 6/2021 | Choi | E05F 15/655 |
| 2022/0090421 | A1 * | 3/2022 | Choi | B60J 5/047 |
| 2022/0090427 | A1 * | 3/2022 | Choi | E05B 83/38 |

FOREIGN PATENT DOCUMENTS

| | | | | |
|---|---|---|---|---|
| DE | 102015012641 | B3 * | 4/2016 | E05D 15/101 |
| DE | 102020110154 | A1 * | 6/2021 | B60J 5/06 |
| EP | 1788177 | A1 * | 5/2007 | B60J 5/06 |
| KR | 20210057616 | A | 5/2021 | |

* cited by examiner

VEHICLE DOOR OPENING AND CLOSING APPARATUS

REFERENCE TO RELATED APPLICATIONS

This application claims the benefit of Korean Patent Application No. 10-2019-0164177, filed on Dec. 10, 2019, in the Korean Intellectual Property Office, which application is hereby incorporated herein by reference.

TECHNICAL FIELD

The present disclosure relates to a vehicle door opening and closing apparatus.

BACKGROUND

Vehicles have door apertures for ingress and egress of vehicle passengers to and from a passenger compartment. A vehicle door is closed to block the door aperture and is opened to enable ingress and egress of passengers to and from the passenger compartment through the door aperture. Vehicle doors are divided into swing doors and sliding doors. The swing door is opened and closed by swinging around a hinge mounted between the swing door and the vehicle body. The sliding door is opened and closed by sliding a roller mounted on the sliding door along a rail mounted on the vehicle body.

The swing door is very easy to open and close, thereby enabling quick ingress and egress of passengers. However, when the swing door is opened, a space for ingress and egress is relatively small. When the vehicle is located in a narrow space, a swing trajectory of the door is not secured, which makes the opening and closing operation thereof difficult.

The sliding door is very easy to open and close even when the vehicle is located in a narrow space. When the sliding door is opened, a space for ingress and egress is relatively large. However, the sliding door requires relatively more force and time to open and close, which hinders quick ingress and egress of passengers.

According to the related art, as a vehicle door is operated by a single opening and closing method, it may be difficult to adequately respond to the needs of customers seeking ease of use, diversity, and novelty.

The above information described in this background section is provided to assist in understanding the background of the inventive concept, and may include any technical concept which is not considered as the prior art that is already known to those skilled in the art.

SUMMARY

Embodiments of the present disclosure solve problems occurring in the prior art while advantages achieved by the prior art are maintained intact.

The present disclosure relates to a vehicle door opening and closing apparatus. Particular embodiments relate to a vehicle door openings and close apparatus allowing a vehicle door to open and close in one mode selected from a sliding mode and a swing mode, and more particularly, to a vehicle door opening and closing apparatus in which a door-side hinge element and a roller-side hinge element of a center roller unit are selectively connected to or released from each other according to a sliding mode and a swing mode.

An aspect of the present disclosure provides a vehicle door opening and closing apparatus allowing a vehicle door to open and close in one mode selected from a sliding mode and a swing mode. In particular, a door-side hinge element and a roller-side hinge element of a center roller unit are selectively connected to or released from each other according to the sliding mode and the swing mode.

According to an aspect of the present disclosure, a vehicle door opening and closing apparatus may include a vehicle body having a door frame defining a door aperture, a vehicle door, a rail mounted on the vehicle body, a roller unit mounted on the vehicle door, moving along the rail, and allowing the vehicle door to open and close in one mode selected from a sliding mode and a swing mode, a center rail extending from an edge of the door aperture, and a center roller unit including rollers guided along the center rail, a roller bracket having the rollers mounted thereon, a roller-side hinge element connected to the roller bracket, and a door-side hinge element rotatably connected to the roller-side hinge element, wherein the roller-side hinge element and the door-side hinge element may be releasably connected.

The roller-side hinge element may be releasably connected to the door frame by a grip unit.

The roller-side hinge element and the door-side hinge element may be releasably connected by a slide hinge, the roller-side hinge element may have a roller-side hinge hole, the door-side hinge element may have a door-side hinge hole aligned with the roller-side hinge hole, and the slide hinge may move along an axis of the roller-side hinge hole and an axis of the door-side hinge hole.

The slide hinge may include a base moving along the axis of the roller-side hinge hole and the axis of the door-side hinge hole, an extension portion extending from the base toward the door-side hinge element and the roller-side hinge element, and a hinge pin extending from the extension portion toward the axis of the roller-side hinge hole and the axis of the door-side hinge hole.

The hinge pin may be releasably inserted into the roller-side hinge hole and the door-side hinge hole by a movement of the base.

The base may be moved by a driving unit between a connection position in which the door-side hinge element and the roller-side hinge element are connected to each other and a release position in which the door-side hinge element and the roller-side hinge element are released from each other.

The driving unit may include a driving motor, a pinion coupled to a driving shaft of the driving motor, and rack teeth meshing with the pinion, and the rack teeth may be arranged in a longitudinal direction of the base.

The roller-side hinge element may have a hinge pin, the door-side hinge element may have a first recess receiving a portion of the hinge pin, the door-side hinge element may include a hinge lug moving along a circumference of the first recess, the hinge lug may have a second recess receiving a portion of the hinge pin, and the first recess and the second recess may selectively define a closed hinge hole or an open hinge hole by a movement of the hinge lug.

The hinge lug may move between a hold position in which the hinge lug holds the hinge pin and a release position in which the hinge lug allows the hinge pin to be released.

The first recess and the second recess may define the closed hinge hole allowing the hinge pin to be held when the hinge lug is in the hold position, and the first recess and the second recess may define the open hinge hole allowing the hinge pin to be released when the hinge lug is in the release position.

The grip unit may include a housing fixed to the door frame, a first grip member pivotally mounted on the housing, and a second grip member pivotally mounted on the housing. The first grip member and the second grip member may be spaced apart from each other and arranged to face each other.

The first grip member may be biased toward a center of the housing by a first biasing element, and the second grip member may be biased toward the center of the housing by a second biasing element.

The grip unit may include a housing fixed to the door frame, a first grip member slidably mounted on the housing, and a second grip member slidably mounted on the housing. The first grip member and the second grip member may be spaced apart from each other and arranged to face each other.

The first grip member may be biased toward a center of the housing by a first biasing element, and the second grip member may be biased toward the center of the housing by a second biasing element.

The grip unit may include a housing fixed to the door frame, a first grip member fixedly mounted on the housing, and a second grip member fixedly mounted on the housing. The first grip member and the second grip member may be spaced apart from each other and arranged to face each other, and the first grip member and the second grip member may elastically press the roller-side hinge element.

The first grip member may have a first closed cavity therein, and the second grip member may have a second closed cavity therein.

BRIEF DESCRIPTION OF THE DRAWINGS

The above and other objects, features and advantages of embodiments of the present disclosure will be more apparent from the following detailed description taken in conjunction with the accompanying drawings, in which.

DETAILED DESCRIPTION OF ILLUSTRATIVE EMBODIMENTS

Figure 1:
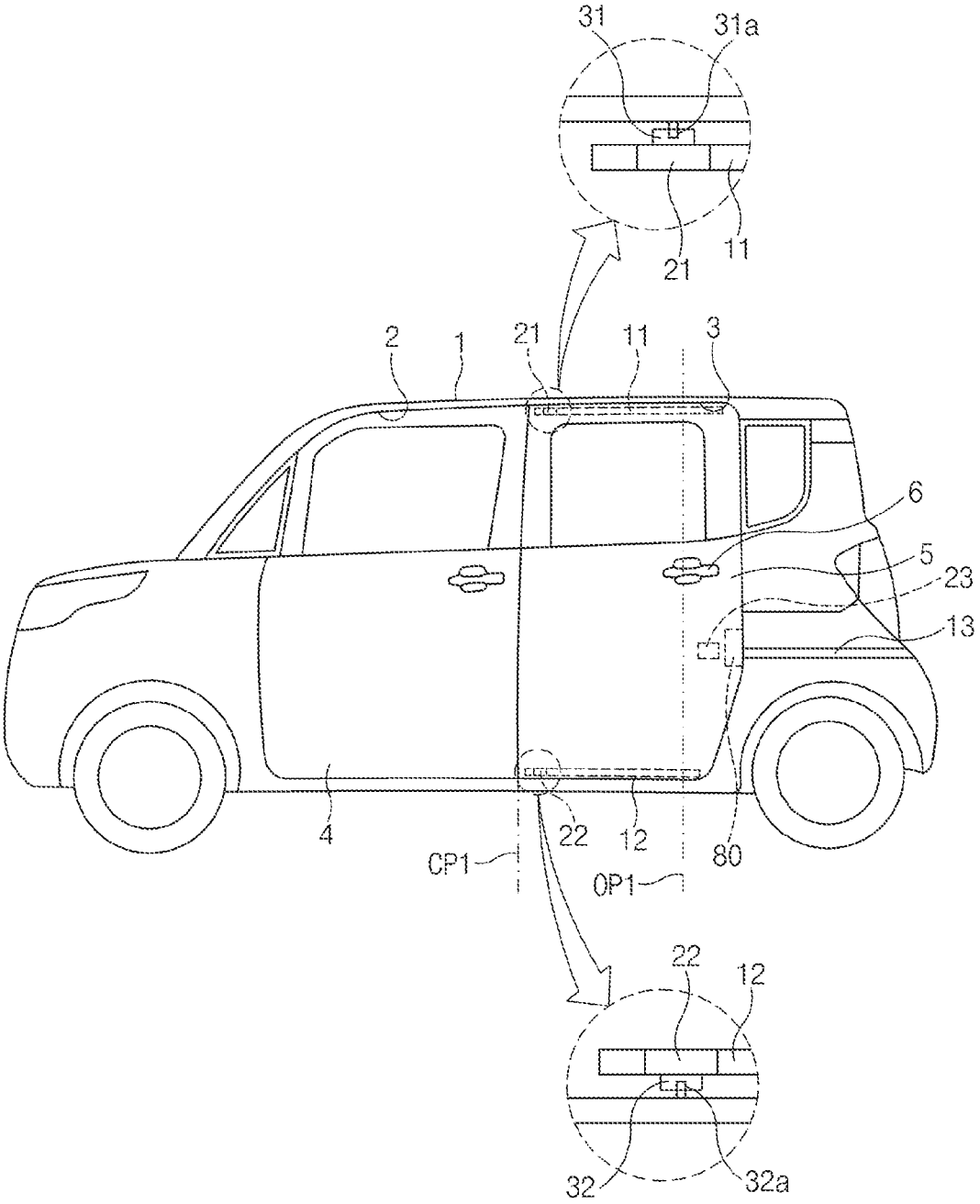
FIG. 1 illustrates a vehicle door opening and closing apparatus according to an exemplary embodiment of the present disclosure, which is mounted on a rear door of a vehicle.

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be omitted in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of aft, and are not to be interpreted as having ideal or excessively formal meanings unless clearly defined as having such in the present application.

A vehicle door opening and closing apparatus, according to exemplary embodiments of the present disclosure, may allow a vehicle door to open and close selectively in either a sliding mode or a swing mode. In other words, the vehicle door opening and closing apparatus, according to exemplary embodiments of the present disclosure, may be a transform-type door opening and closing apparatus. The sliding mode may allow the vehicle door to open and close by sliding in a longitudinal direction of a vehicle, and the swing mode may allow the vehicle door to open and close by swinging inwards and outwards.

Referring to FIG. 1, a vehicle body 1 may have a plurality of door apertures 2 and 3, and the plurality of door apertures 2 and 3 may be divided into a front aperture 2 and a rear aperture 3. A plurality of vehicle doors 4 and 5 may include a front door 4 covering and uncovering the front aperture 2, and a rear door 5 covering and uncovering the rear aperture 3. As the front door 4 is opened, the front door 4 may uncover the front aperture 2, and as the front door 4 is closed, the front door 4 may cover the front aperture 2. As the rear door 5 is opened, the rear door 5 may uncover the rear aperture 3, and as the rear door 5 is closed, the rear door 5 may cover the rear aperture 3.

The vehicle door opening and closing apparatus, according to exemplary embodiments of the present disclosure, may be applied to the front door 4, the rear door 5, and the like. FIGS. 1 to 16 illustrate a vehicle door opening and closing apparatus according to exemplary embodiments of the present disclosure, which is applied to the rear door 5. Hereinafter, the rear door 5 will be referred to as the vehicle door 5, and the rear aperture 3 will be referred to as the door aperture 3.

The vehicle door opening and closing apparatus, according to exemplary embodiments of the present disclosure, may include one or more rails 11 and 12 mounted on the vehicle body 1, and the rails 11 and 12 may extend in the longitudinal direction of the vehicle. Referring to FIG. 1, an upper rail 11 may be mounted on an upper edge of the vehicle body 1, and a lower rail 12 may be mounted on a lower edge of the vehicle body 1. The upper rail 11 and the lower rail 12 may extend in the longitudinal direction of the vehicle. The upper rail 11 may be disposed on an upper edge of the door aperture 3, and the lower rail 12 may be disposed on a lower edge of the door aperture 3.

The vehicle door opening and closing apparatus, according to exemplary embodiments of the present disclosure, may include roller units 21 and 22 guided along the rails 11 and 12. The roller units 21 and 22 may allow the vehicle door 5 to open and close in one mode selected from the sliding mode and the swing mode. In particular, the roller units 21 and 22 may be releasably held in predetermined positions of the rails 11 and 12 by hold locks 31 and 32. Specifically, when the roller units 21 and 22 are held in the predetermined positions of the rails 11 and 12 by the hold locks 31 and 32, the vehicle door 5 may be opened and closed in the swing mode in which the vehicle door swings in the predetermined positions of the rails 11 and 12. When the roller units 21 and 22 are released by the hold locks 31 and 32, the vehicle door 5 may be opened and closed in the sliding mode in which the vehicle door slides along the rails 11 and 12.

Figure 3:
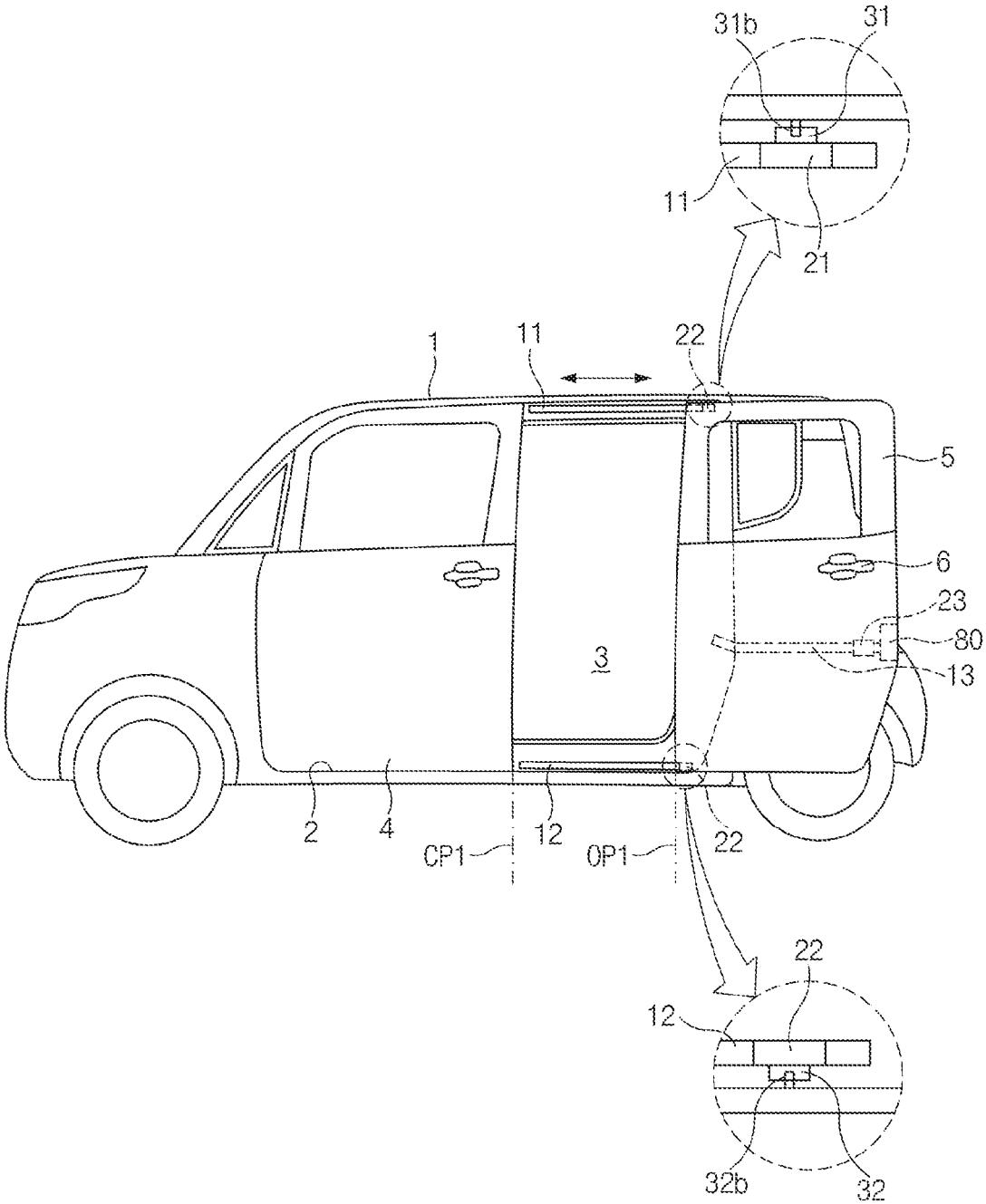
FIG. 3 illustrates a state in which the door of FIG. 1 is opened in a sliding mode.

Referring to FIGS. 1 and 3, an upper roller unit 21 may be mounted on an upper end of the vehicle door 5, and the upper roller unit 21 may slide along the upper rail 11. A lower roller unit 22 may be mounted on a lower end of the vehicle door 5, and the lower roller unit 22 may slide along the lower rail 12.

Figure 2:
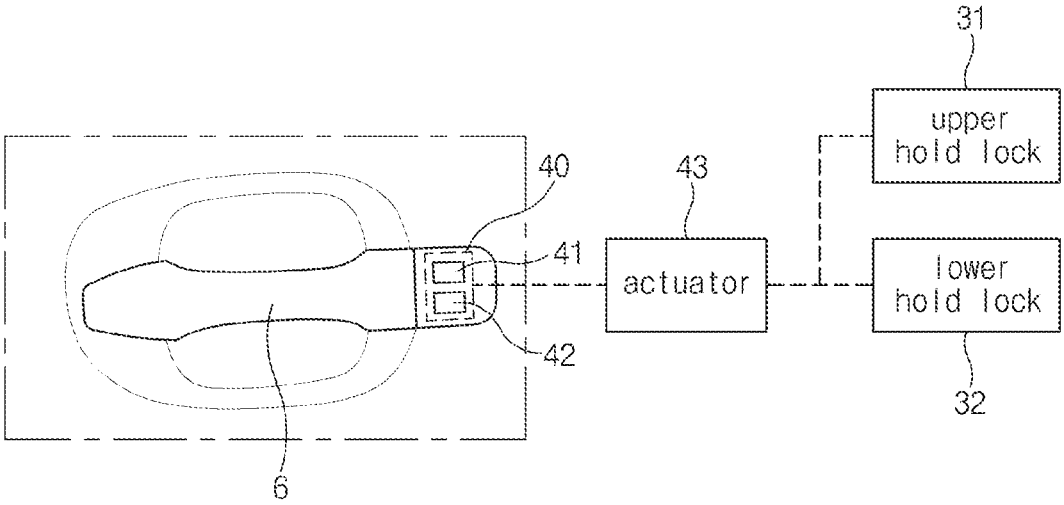
FIG. 2 illustrates a selector adjacent to an outside handle of a vehicle, an actuator connected to the selector, and hold locks.

Referring to FIG. 2, the vehicle door 5 may include an outside handle 6, and a selector 40 for selecting the sliding mode and the swing mode may be adjacent to the outside handle 6. The selector 40 may have a first switch 41 selecting the sliding mode, and a second switch 42 selecting the swing mode.

When a user presses the first switch 41 and the sliding mode is selected, the vehicle door 5 may slide along the upper rail 11, the lower rail 12, and a center rail 13 as illustrated in FIG. 3 as the user pushes or pulls the outside handle 6 toward the front or rear of the vehicle. In the sliding mode, the vehicle door 5 may move between a first open position OP1 and a first closed position CP1, as illustrated in FIGS. 1 and 3. The first open position OP1 refers to a position in which the vehicle door 5 is fully opened, and the first closed position CP1 refers to a position in which the vehicle door 5 is fully closed.

Figure 4:
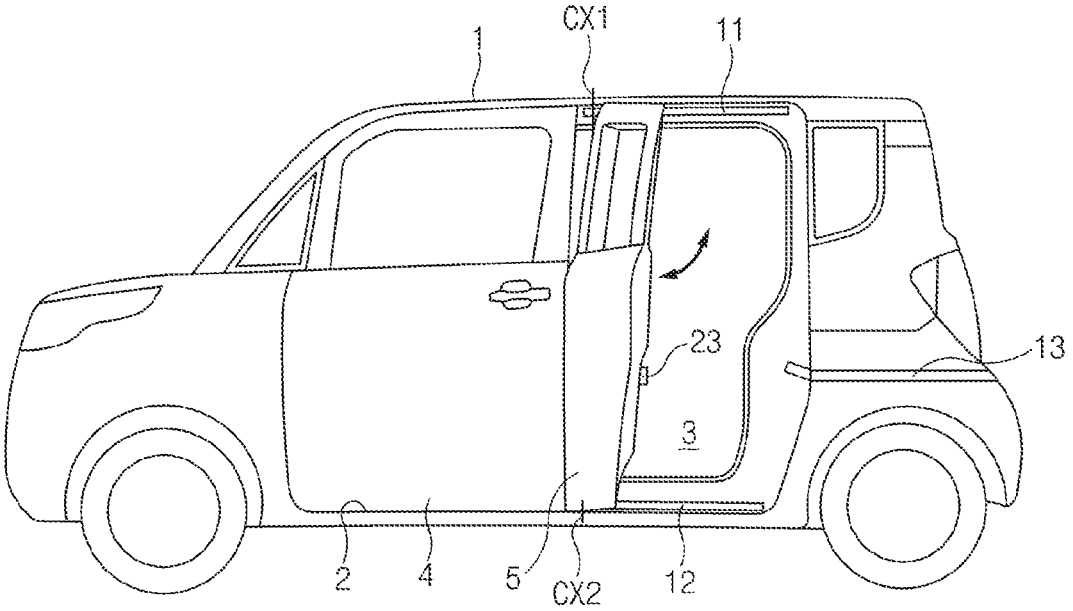
FIG. 4 illustrates a state in which the door of FIG. 1 is opened in a swing mode.
Figure 7:
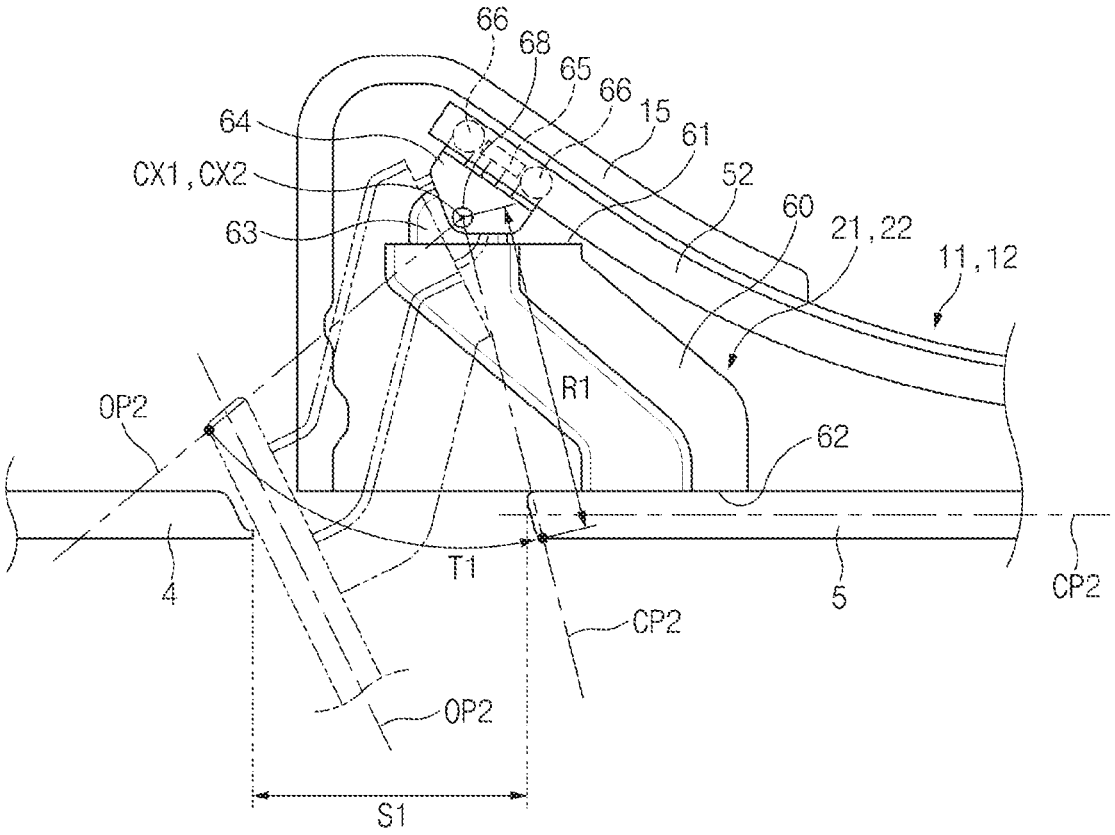
FIG. 7 illustrates an operation in which a vehicle door is opened and closed in a swing mode by an upper roller unit and a lower roller unit of a vehicle door opening and closing apparatus according to an exemplary embodiment of the present disclosure.
Figure 9:
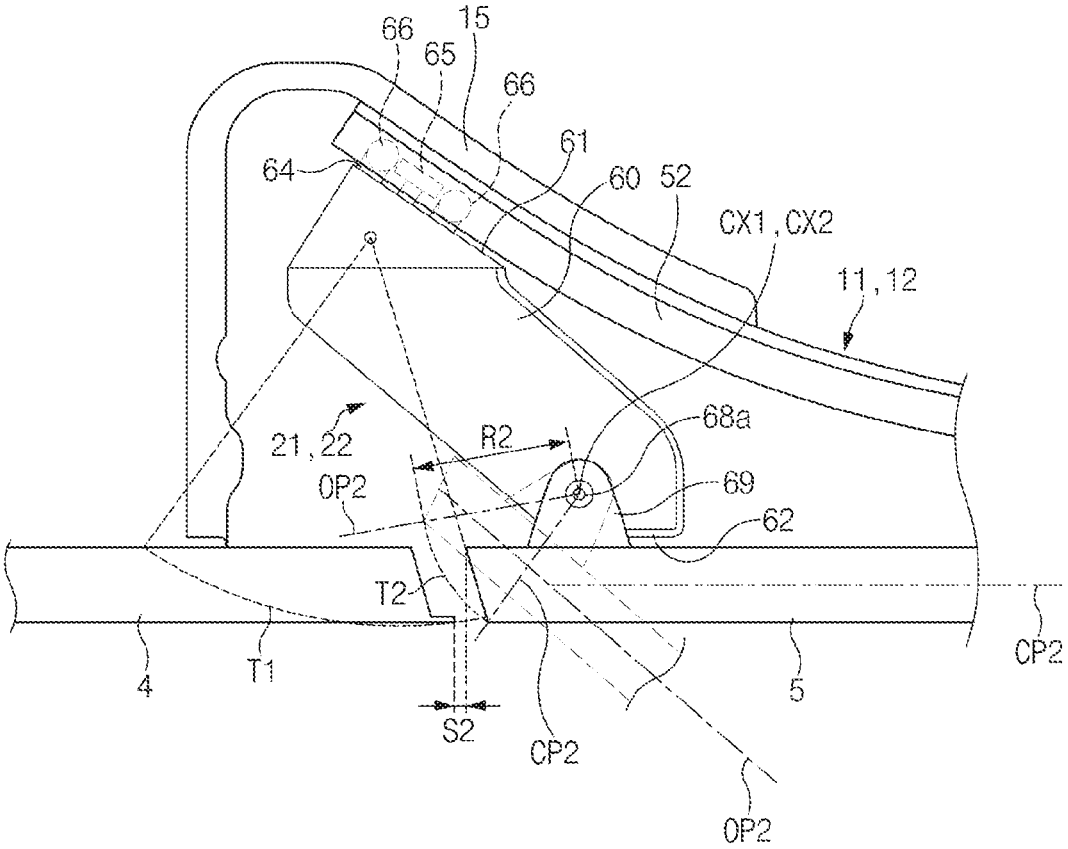
FIG. 9 illustrates an operation in which a vehicle door is opened and closed in a swing mode by an upper roller unit and a lower roller unit of a vehicle door opening and closing apparatus according to another exemplary embodiment of the present disclosure.

When the user presses the second switch 42 and the swing mode is selected, the vehicle door 5 may swing as illustrated in FIG. 4 as the user pushes or pulls the outside handle 6 toward a passenger compartment or the exterior side of the vehicle. In the swing mode, the vehicle door 5 may move between a second open position OP2 in which the vehicle door 5 is fully opened and a second closed position CP2 in which the vehicle door 5 is fully closed, as illustrated in FIGS. 7 and 9. In particular, when the vehicle door 5 is held in the first closed position CP1, it may be operated in the swing mode.

The upper roller unit 21 may have an upper hold lock 31, and the vehicle body 1 may have a first upper striker 31*a* and a second upper striker 31*b* protruding downwardly from a roof of the vehicle body 1. The first upper striker 31*a* may be aligned with or adjacent to a virtual axis of the first closed position CP1, and the second upper striker 31*b* may be aligned with or adjacent to a virtual axis of the first open position OP1.

According to an exemplary embodiment, as illustrated in FIGS. 1 and 3, the upper hold lock 31 may releasably hold the first upper striker 31*a* in the first closed position CP1, and releasably hold the second upper striker 31*b* in the first open position OP1. That is, one upper hold lock 31 may selectively hold the first upper striker 31*a* and the second upper striker 31*b*. As the upper hold lock 31 holds the first upper striker 31*a*, the upper roller unit 21 may be held in the first closed position CP1. As the upper hold lock 31 holds the second upper striker 31*b*, the upper roller unit 21 may be held in the first open position OP1.

According to another exemplary embodiment, the upper hold lock 31 may releasably hold the first upper striker 31*a* in the first closed position CP1, and a separate upper open hold lock (not shown) may releasably hold the second upper striker 31*b* in the first open position OP1. That is, the upper hold lock 31, which releasably holds the first upper striker 31*a* in the first closed position CP1, and the upper open hold lock, which releasably holds the second upper striker 31*b* in the first open position OP1, may be individually mounted on the upper roller unit 21.

Referring to FIGS. 4 and 9, the upper roller unit 21 may have an upper rotation axis CX1, and the vehicle door 5 may rotate around the upper rotation axis CX1. When the upper roller unit 21 is firmly held in the first closed position CP1 by the upper hold lock 31 and the first upper striker 31*a*, the vehicle door 5 may rotate around the upper rotation axis CX1.

The lower roller unit 22 may have a lower hold lock 32, and the vehicle body 1 may have a first lower striker 32*a* and a second lower striker 32*b* protruding upwardly from the bottom of the vehicle body 1. The first lower striker 32*a* may be aligned with or adjacent to the virtual axis of the first closed position CP1, and the second lower striker 32*b* may be aligned with or adjacent to the virtual axis of the first open position OP1.

According to an exemplary embodiment, as illustrated in FIGS. 1 and 3, the lower hold lock 32 may releasably hold the first lower striker 32*a* in the first closed position CP1, and releasably hold the second lower striker 32*b* in the first open position OP1. That is, one lower hold lock 32 may selectively hold the first lower striker 32*a* and the second lower striker 32*b*. As the lower hold lock 32 holds the first lower striker 32*a*, the lower roller unit 22 may be firmly held in the first closed position CP1. As the lower hold lock 32 holds the second lower striker 32*b*, the lower roller unit 22 may be firmly held in the first open position OP1.

According to another exemplary embodiment, the lower hold lock 32 may releasably hold the first lower striker 32*a* in the first closed position CP1, and a separate lower open hold lock (not shown) may releasably hold the second lower striker 32*b* in the first open position OP1. That is, the lower hold lock 32, which releasably holds the first lower striker 32*a* in the first closed position CP1, and the lower open hold lock, which releasably holds the second lower striker 32*b* in the first open position OP1, may be individually mounted on the lower roller unit 22.

Referring to FIGS. 4 and 9, the lower roller unit 22 may have a lower rotation axis CX2, and the vehicle door 5 may rotate around the lower rotation axis CX2. When the lower roller unit 22 is firmly held in the first closed position CP1 by the lower hold lock 32 and the first lower striker 32*a*, the vehicle door 5 may rotate around the lower rotation axis CX2.

As illustrated in FIG. 4, the upper rotation axis CX1 and the lower rotation axis CX2 may be vertically aligned, and the vehicle door 5 may rotate around the vertically aligned upper and lower rotation axes CX1 and CX2.

Referring to FIG. 2, the selector 40 may be electrically connected to an actuator 43, and the actuator 43 may be configured to operate the upper hold lock 31 and the lower hold lock 32.

As the user selects the selector 40, the actuator 43 may selectively perform a hold operation in which the upper hold lock 31 holds the first upper striker 31*a* and the lower hold lock 32 holds the first lower striker 32*a*, and a release operation in which the upper hold lock 31 releases the first upper striker 31*a* and the lower hold lock 32 releases the first lower striker 32*a*.

When the user presses the first switch 41 of the selector 40 in a state in which the vehicle door 5 is closed, the upper hold lock 31 may release the first upper striker 31*a* and the lower hold lock 32 may release the first lower striker 32*a* simultaneously by the release operation of the actuator 43. Thus, the user may slide the vehicle door 5 in the longitudinal direction of the vehicle body 1 so that the vehicle door 5 may be opened and closed in the sliding mode.

When the user presses the second switch 42 of the selector 40 in a state in which the vehicle door 5 is closed, the upper hold lock 31 may hold the first upper striker 31*a* and the lower hold lock 32 may hold the first lower striker 32*a* simultaneously by the hold operation of the actuator 43, and the upper roller unit 21 and the lower roller unit 22 may be firmly held in the first closed position CP1. Thus, the user may swing the vehicle door 5 toward the interior space or exterior of the vehicle so that the vehicle door 5 may be opened and closed in the swing mode.

According to an exemplary embodiment, as illustrated in FIG. 2, one actuator 43 may operate the upper hold lock 31 and the lower hold lock 32 simultaneously.

According to another exemplary embodiment, an actuator operating the upper hold lock 31 and another actuator operating the lower hold lock 32 may be individually connected to the selector 40.

FIGS. 10A to 10D illustrate the upper hold lock 31 and the lower hold lock 32 according to an exemplary embodiment of the present disclosure. Referring to FIGS. 10A to 10D, each of the upper hold lock 31 and the lower hold lock 32 may include a catch 71, a pawl 72 releasably engaging with the catch 71, and a lever 73 operatively connected to the pawl 72. The lever 73 may be connected to the actuator 43 through a cable 75. As the cable 75 is reversed (pulled) by the actuator 43, the catch 71 may release the strikers 31*a* and 32*a*. A portion of the catch 71, the pawl 72, and the lever 73 may be covered by a cover plate 76, and the cover plate 76 may be attached to a mounting plate 74. The strikers 31*a* and 32*a* may be fixed to the vehicle body 1 by a mounting plate 78.

Referring to FIGS. 10A to 10D, the upper hold lock 31 may releasably hold the first upper striker 31*a*, and the lower hold lock 32 may releasably hold the first lower striker 32*a*.

Figure 10A:
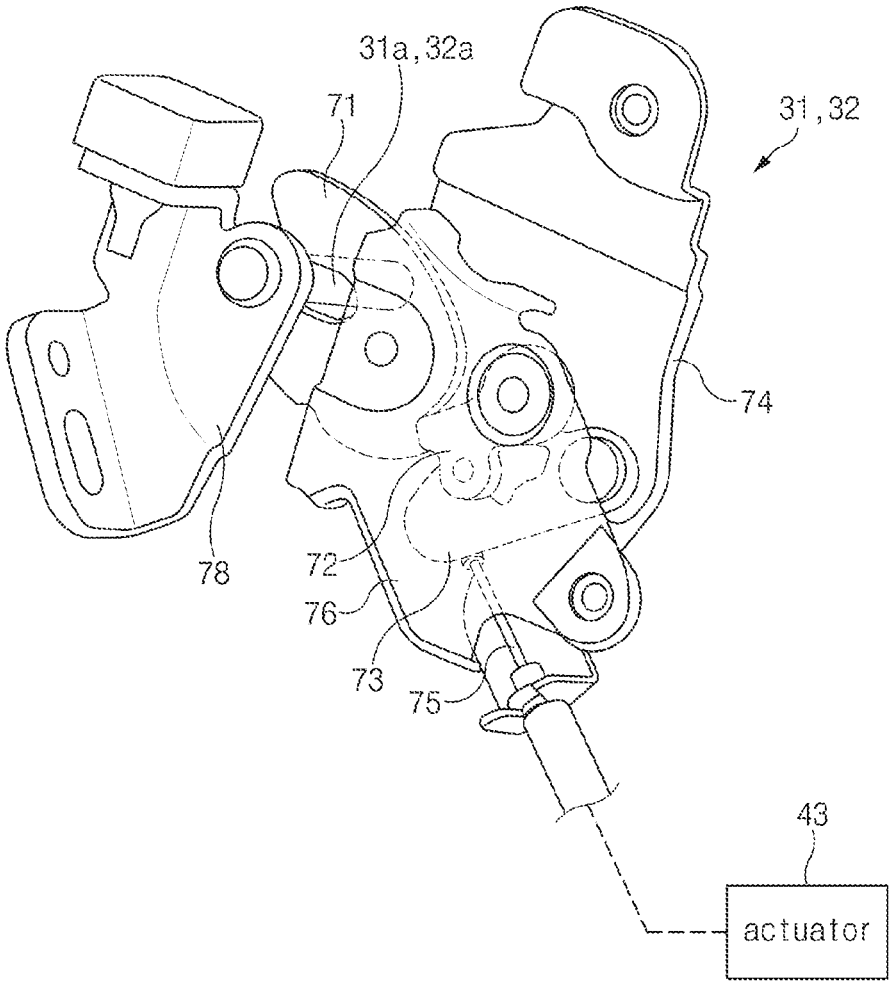
FIG. 10A illustrates a perspective view of an upper hold lock and a lower hold lock.
Figure 10B:
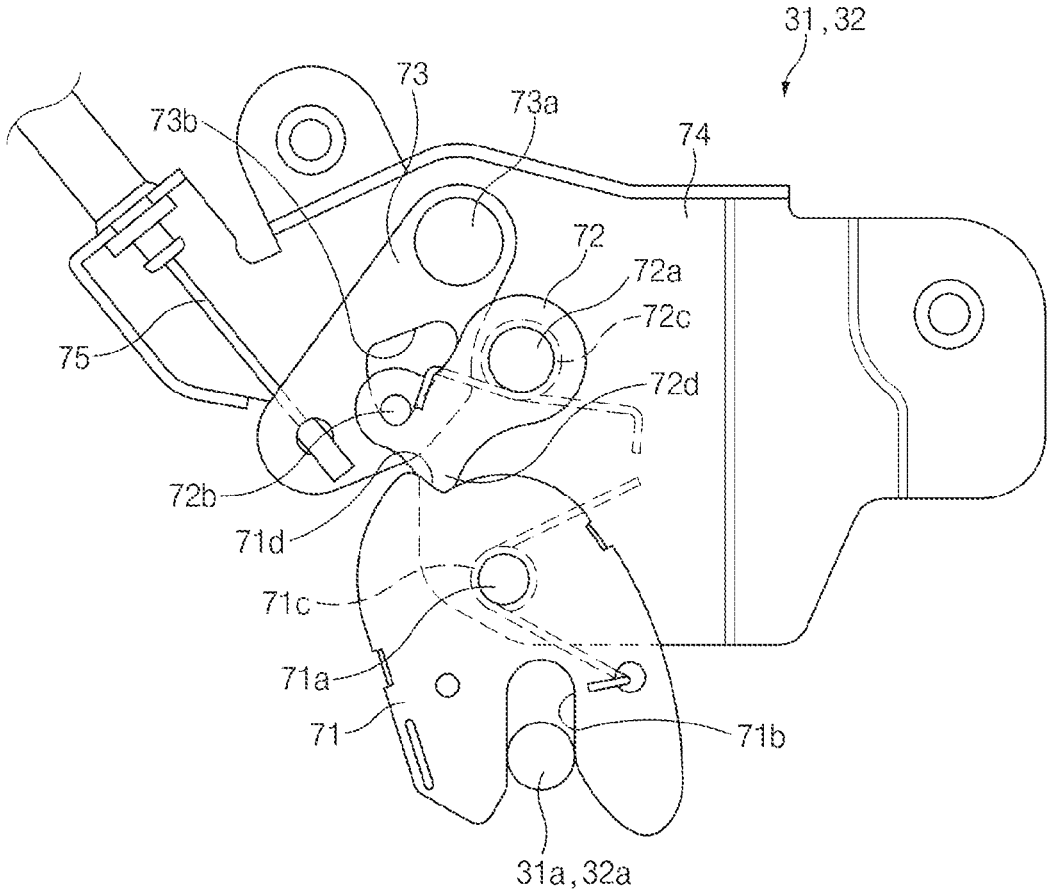
FIG. 10B illustrates a state in which an upper hold lock and a lower hold lock hold corresponding strikers.
Figure 10C:
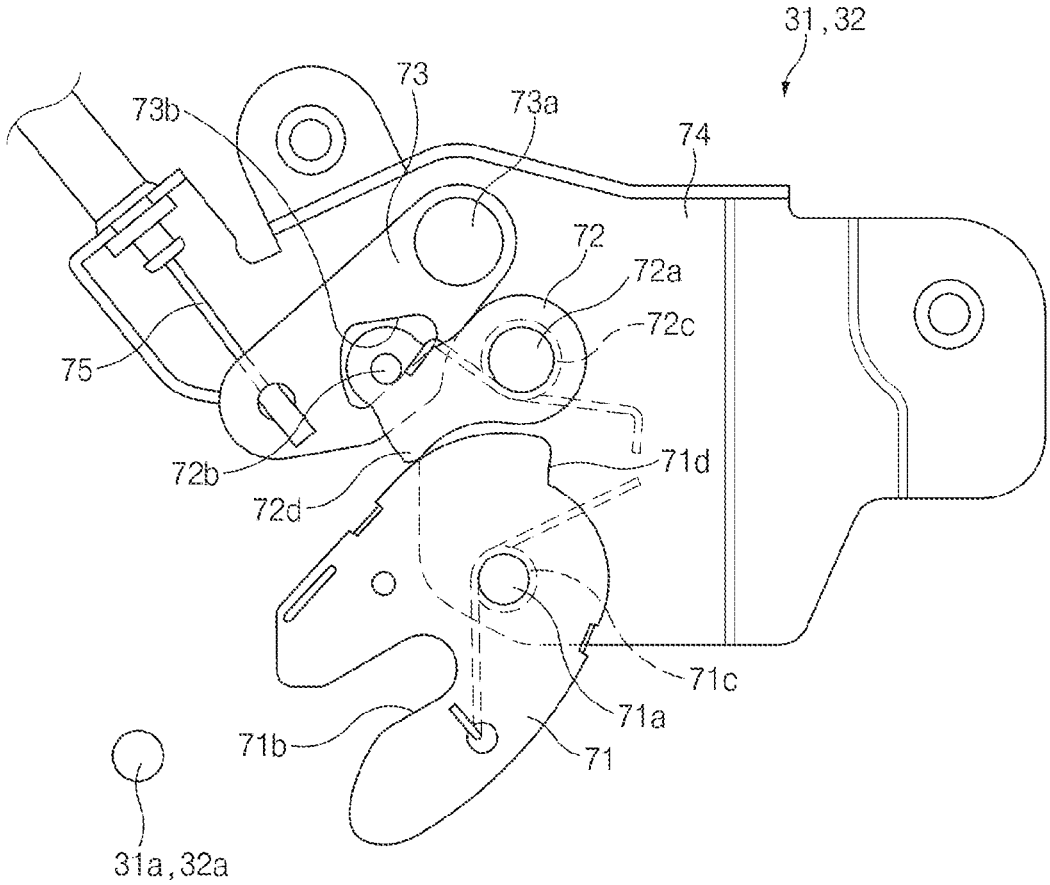
FIG. 10C illustrates a state in which an upper hold lock and a lower hold lock release corresponding strikers.

The catch 71 may be pivotally mounted on the mounting plate 74 through a first pivot shaft via. The catch 71 may have a slot 71*b* receiving the strikers 31*a* and 32*a*, and the catch 71 may engage with or release the strikers 31*a* and 32*a*. The catch 71 may move between an engaging position (see FIG. 10B) and a release position (see FIG. 10C). The engaging position refers to a position in which the catch 71 engages with the strikers 31*a* and 32*a* as illustrated in FIG. 10B, and the release position refers to a position in which the catch 71 releases the strikers 31*a* and 32*a* as illustrated in FIG. 10C. When the catch 71 is in the engaging position as illustrated in FIG. 10B, the catch 71 may engage with the strikers 31*a* and 32*a* so that the catch 71 may hold the strikers 31*a* and 32*a*. When the catch 71 is in the release position as illustrated in FIG. 10C, the catch 71 may release the strikers 31*a* and 32*a*. Thus, the strikers 31*a* and 32*a* may be released from the slot 71*b* of the catch 71 or be received in the slot 71*b* of the catch 71. The catch 71 may be biased toward the release position by a first biasing element 71*c* such as a torsion spring. The first biasing element 71*c* may be disposed around the first pivot shaft via. The catch 71 may have a locking shoulder 71*d*.

Figure 10D:
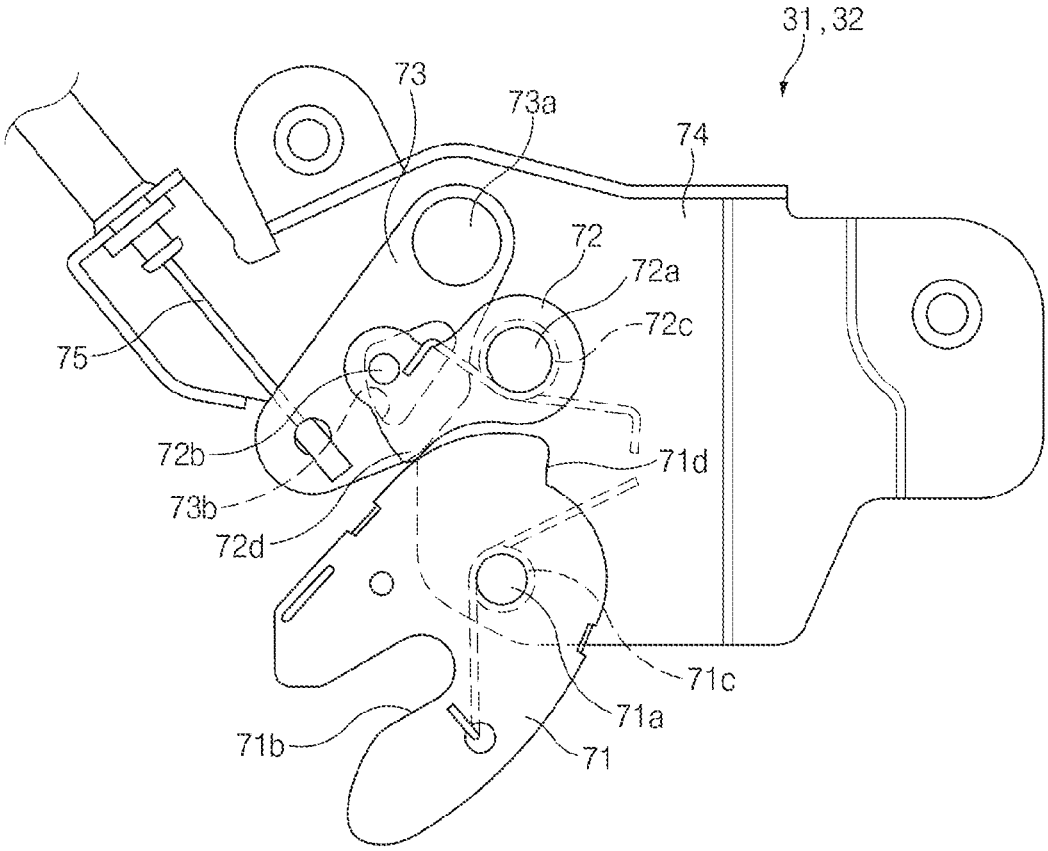
FIG. 10D illustrates a state in which an upper hold lock and a lower hold lock are allowed to receive corresponding strikers.

The pawl 72 may be pivotally mounted on the mounting plate 74 through a second pivot shaft 72*a*, and the pawl 72 may move between a pawl locking position (see FIG. 10B) and a pawl release position (see FIGS. 10C and 10D). The pawl locking position refers to a position in which the pawl 72 engages with the catch 71 and the catch 71 is kept in the engaging position, and the pawl release position refers to a position in which the pawl 72 releases the catch 71 and the catch 71 is allowed to move from the engaging position to the release position. As illustrated in FIG. 10B, when the pawl 72 is in the pawl locking position, the movement (rotation) of the catch 71 may be restricted by the pawl 72 so that the catch 71 may be kept in the engaging position. As illustrated in FIGS. 10C and 10D, when the pawl 72 is in the pawl release position, the movement (rotation) of the catch 71 may not be restricted by the pawl 72 so that the catch 71 may move from the engaging position to the release position. The pawl 72 may be biased toward the pawl locking position (see FIG. 10B) by a second biasing element 72*c* such as a torsion spring. The second biasing element 72*c* may be disposed around the second pivot shaft 72*a*.

The pawl 72 may have a locking projection 72*d* locked to the locking shoulder 71*d* of the catch 71. As illustrated in FIG. 10B, as the pawl 72 is moved to the pawl locking position by the second biasing element 72*c*, the locking projection 72*d* of the pawl 72 may be locked to the locking shoulder 71*d* of the catch 71 and the movement (rotation) of the catch 71 may be restricted, so that the catch 71 may be kept in the engaging position. As illustrated in FIG. 10C, as the pawl 72 is moved to the pawl release position by the lever 73, the locking projection 72*d* of the pawl 72 may be released from the locking shoulder 71*d* of the catch 71 and the movement (rotation) of the catch 71 may be allowed, so that the catch 71 may be moved to the release position by the first biasing element 71*c*.

The lever 73 may be pivotally mounted on the mounting plate 74 through a third pivot shaft 73*a*. The lever 73 may be connected to the actuator 43 through the cable 75. An end of the cable 75 may be fixed to the lever 73, and the cable 75 may be advanced or reversed by the actuator 43. As the actuator 43 moves the cable 75, the lever 73 may pivot around the third pivot shaft 73*a*. As the cable 75 is reversed, the lever 73 may move the pawl 72 to the pawl release position (see FIG. 10C).

The lever 73 may be operatively connected to the pawl 72 through a pin 72*b* and an opening 73*b*. The pin 72*b* may be provided on the pawl 72, and the opening 73*b* may be provided in the lever 73. The pin 72*b* may be movably received in the opening 73*b*. As the lever 73 pivots around the third pivot shaft 73*a*, the pin 72*b* may move in the opening 73*b*, allowing the pawl 72 to move.

As illustrated in FIG. 10B, when the cable 75 is advanced by the actuator 43, the locking projection 72*d* of the pawl 72 may be locked to the locking shoulder 71*d* of the catch 71 and the movement (rotation) of the catch 71 may be restricted so that the catch 71 may be kept in the engaging position. The strikers 31*a* and 32*a* may be held in the slot 71*b* of the catch 71. That is, the upper hold lock 31 and the lower hold lock 32 may hold the corresponding strikers 31*a* and 32*a*.

As illustrated in FIG. 10C, when the cable 75 is reversed by the actuator 43, the lever 73 may move the pawl 72 to the pawl release position. The locking projection 72*d* of the pawl 72 may be released from the locking shoulder 71*d* of the catch 71 and the movement (rotation) of the catch 71 may be allowed, so that the catch 71 may be moved to the release position by the first biasing element 71*c*, and the strikers 31*a* and 32*a* may be released from the slot 71*b* of the catch 71. Thus, the upper hold lock 31 and the lower hold lock 32 may release the corresponding strikers 31*a* and 32*a*, and the upper roller unit 21 and the lower roller unit 22 may slide along the upper rail 11 and the lower rail 12.

As illustrated in FIG. 10D, even though the cable 75 is advanced by the actuator 43 in a state in which the locking projection 72*d* of the pawl 72 is released from the locking shoulder 71*d* of the catch 71, the catch 71 may be kept in the release position by the first biasing element 71*c* so that the movement (rotation) of the catch 71 may be allowed. In this state, the strikers 31*a* and 32*a* may be allowed to be received in the slot 71*b* of the catch 71. That is, in a state in which the movement (rotation) of the catch 71 is allowed as the locking projection 72*d* of the pawl 72 is released from the locking shoulder 71*d* of the catch 71, when the upper roller unit 21 and the lower roller unit 22 slide between the first closed position CP1 and the first open position OP1, the strikers 31*a* and 32*a* may be allowed to be received in the slot 71*b* of the catch 71. When a force applied by the upper hold lock 31 and the lower hold lock 32 in a state in which the strikers 31*a* and 32*a* are received in the slot 71*b* of the catch 71 is greater than a spring force of the first biasing element 71*c*, the catch 71 may be moved to the engaging position. As illustrated in FIG. 10B, as the locking projection 72*d* of the pawl 72 is locked to the locking shoulder 71*d* of the catch 71, the catch 71 may hold the strikers 31*a* and 32*a*.

Figure 5:
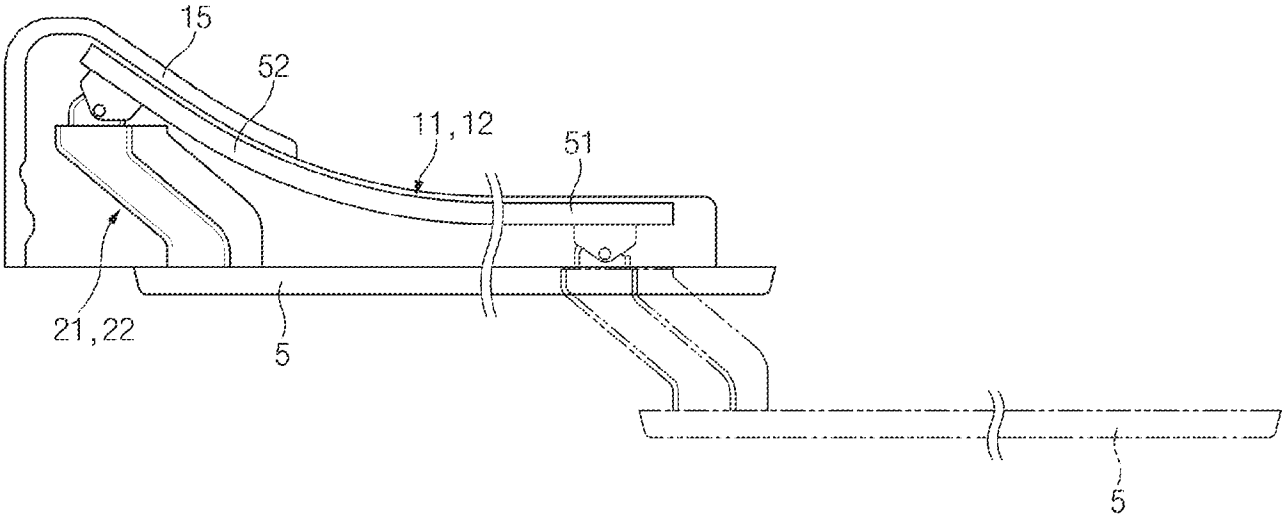
FIG. 5 illustrates an operation in which an upper roller unit and a lower roller unit move along an upper rail and a lower rail in a vehicle door opening and closing apparatus according to an exemplary embodiment of the present disclosure.

Referring to FIG. 5, each of the upper rail 11 and the lower rail 12 may be mounted on the vehicle body 1 through a mounting bracket 15, and the mounting bracket 15 may have a shape corresponding to that of the upper rail 11 and the lower rail 12. Each of the upper rail 11 and the lower rail 12 may have a first extension portion 51 extending straightly in the longitudinal direction of the vehicle, and a second extension portion 52 extending from the first extension portion 51 toward the interior space of the vehicle. The second extension portion 52 may be bent with respect to the first extension portion 51 at a predetermined angle.

Figure 6:
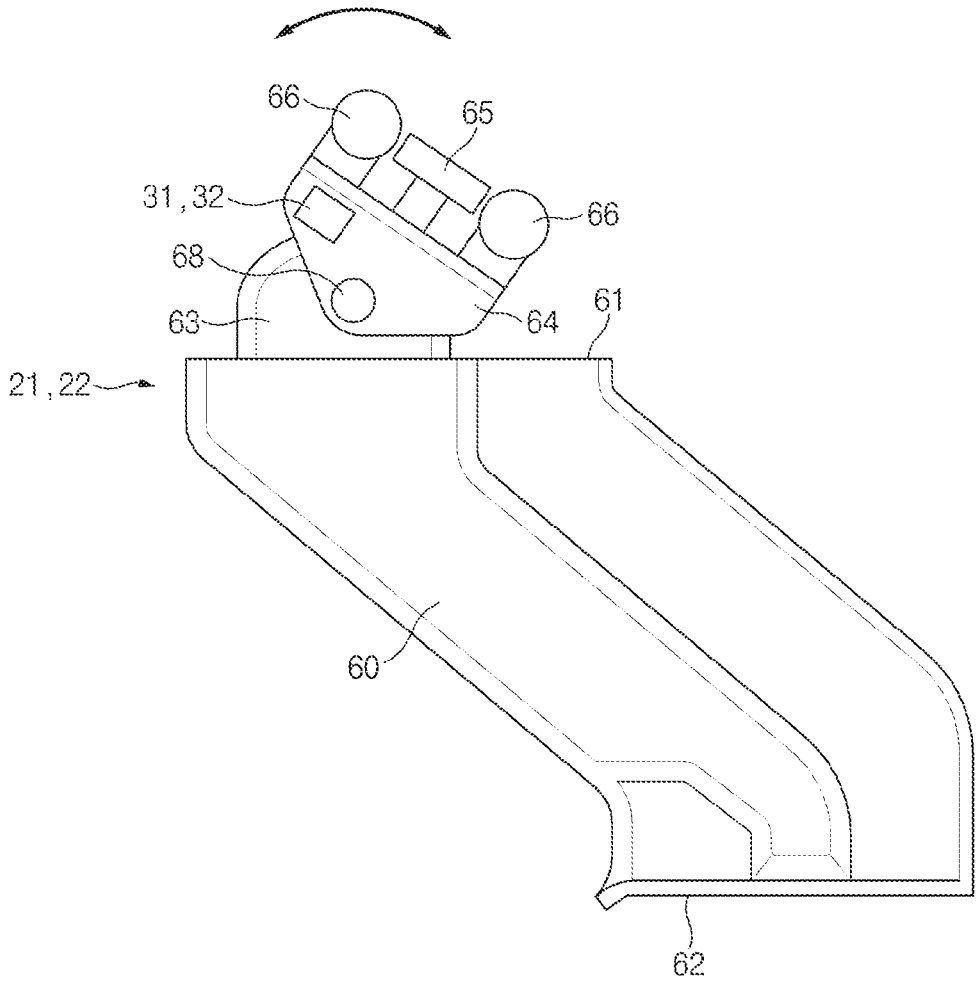
FIG. 6 illustrates an upper roller unit and a lower roller unit in a vehicle door opening and closing apparatus according to an exemplary embodiment of the present disclosure.

Referring to FIG. 6, each of the upper roller unit 21 and the lower roller unit 22 may include a roller bracket 64 having rollers 65 and 66 rolling along the rails 11 and 12, and a body 60 connecting the roller bracket 64 and the vehicle door 5.

The body 60 may extend diagonally so as not to contact the first extension portion 51 and the second extension portion 52. The body 60 may have a first end portion 61 facing the interior side of the vehicle, and a second end portion 62 facing the exterior side of the vehicle. The first end portion 61 of the body 60 may be attached to the roller bracket 64, and the second end portion 62 of the body 60 may be attached to the vehicle door 5.

The roller bracket 64 may rotatably support the rollers 65 and 66, and the rollers 65 and 66 may roll along the upper rail n and the lower rail 12. As illustrated in FIG. 6, a middle roller 65 and two side rollers 66 disposed on both sides of the middle roller 65 may be rotatably mounted on the roller bracket 64. A rotation axis of the middle roller 65 may be orthogonal to a rotation axis of the side roller 66.

According to an exemplary embodiment, as illustrated in FIG. 6, the first end portion 61 of the body 60 may be pivotally connected to the roller bracket 64 through a pivot pin 68, and the second end portion 62 of the body 60 may be fixed to the vehicle door 5. Thus, the vehicle door 5 may swing around the pivot pin 68 adjacent to the roller bracket 64. The body 60 may have a pivot lug 63 protruding from the first end portion 61 toward the roller bracket 64, and the roller bracket 64 may be connected to the pivot lug 63 through the pivot pin 68. The roller bracket 64 may be shaped so as not to interfere with the body 60 when the vehicle door 5 swings. The upper rotation axis CX1 and the lower rotation axis CX2 may be defined by the pivot pin 68. For example, the upper rotation axis CX1 and the lower rotation axis CX2 may be a virtual axis extending vertically along a center point of the pivot pin 68, and the upper rotation axis CX1 and the lower rotation axis CX2 may be vertically aligned, so that the vehicle door 5 may swing around the vertical rotation axis that virtually connects the upper rotation axis CX1 and the lower rotation axis CX2. The upper hold lock 31 may be fixed to the roller bracket 64 of the upper roller unit 21, and the lower hold lock 32 may be fixed to the roller bracket 64 of the lower roller unit 22.

When, by the hold operation of the actuator 43, the upper hold lock 31 firmly holds the roller bracket 64 of the upper roller unit 21 in the first closed position CP1 and the lower hold lock 32 firmly holds the roller bracket 64 of the lower roller unit 22 in the first closed position CP1, the vehicle door 5 may swing around the upper rotation axis CX1 of the upper roller unit 21 and the lower rotation axis CX2 of the lower roller unit 22 as illustrated in FIG. 7. The vehicle door 5 may move between the second closed position CP2 in which the vehicle door 5 is closed and the second open position OP2 in which the vehicle door 5 is opened. When the vehicle door 5 swings, the other adjacent door 4 or other components may be spaced apart from the vehicle door 5 by a predetermined gap S1 so that any interference with the door 4 or the other components may be prevented. For example, the vehicle door 5 may be a rear door, and the other adjacent door 4 may be a front door.

According to the exemplary embodiment illustrated in FIGS. 6 and 7, as the pivot pin 68 is located between the roller bracket 64 and the first end portion 61 of the body 60, the rotation axes CX1 and CX2 of the vehicle door 5 may be relatively far from the vehicle door 5. Since a swing trajectory T1 and a rotation radius R1 of the vehicle door 5 are relatively increased, the gap S1 between the vehicle door 5 and the other adjacent door 4 may be relatively increased. If the gap S1 between the vehicle door 5 and the other adjacent door 4 is reduced, the vehicle door 5 may interfere with the adjacent door 4 when the vehicle door 5 moves toward the second open position OP2, and an open space created by the swing of the vehicle door 5 may be relatively narrowed since the swing trajectory T1 of the vehicle door 5 is relatively reduced.

Figure 8:
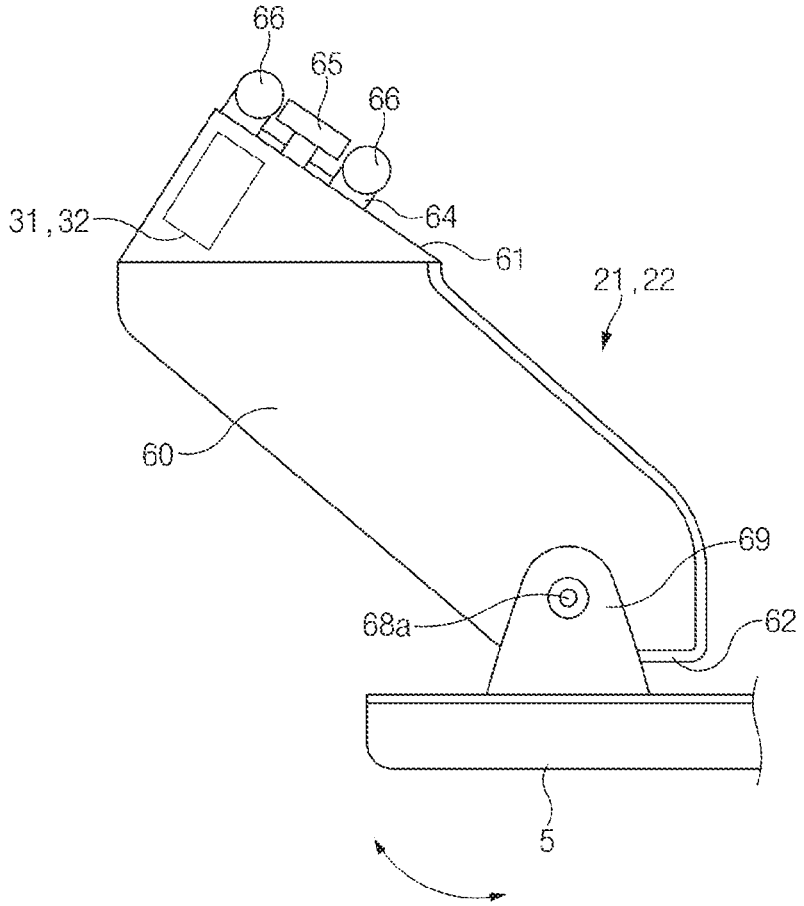
FIG. 8 illustrates an upper roller unit and a lower roller unit in a vehicle door opening and closing apparatus according to another exemplary embodiment of the present disclosure.

According to another exemplary embodiment, as illustrated in FIGS. 8 and 9, the first end portion 610 of the body 60 may be fixed to the roller bracket 64, and the second end portion 62 of the body 60 may be pivotally connected to the vehicle door 5 through a pivot pin 68*a*. Thus, the vehicle door 5 may swing around the pivot pin 68*a* adjacent to the second end portion 62 of the body 60.

Referring to FIGS. 8 and 9, the roller bracket 64 may be fixed to the first end portion 6*i* of the body 60 by welding, using fasteners, and/or the like, and the second end portion 62 of the body 60 may be pivotally connected to the vehicle door 5 through the pivot pin 68*a*. The vehicle door 5 may have a pivot lug 69 protruding toward the body 60, and the pivot lug 69 may be pivotally connected to the second end portion 62 of the body 60 through the pivot pin 68*a*. The second end portion 62 of the body 60 may be shaped so as not to interfere with the vehicle door 5 when the vehicle door 5 swings. The upper rotation axis CX1 and the lower rotation axis CX2 may be defined by the pivot pin 68*a*. For example, the upper rotation axis CX1 and the lower rotation axis CX2 may be a virtual axis extending vertically along a center point of the pivot pin 68*a*, and the upper rotation axis CX1 and the lower rotation axis CX2 may be vertically aligned, so that the vehicle door 5 may swing around the vertical rotation axis that virtually connects the upper rotation axis CX1 and the lower rotation axis CX2. The upper hold lock 31 may be fixed to the body 60 of the upper roller unit 21, and the lower hold lock 32 may be fixed to the body 60 of the lower roller unit 22.

Referring to FIG. 9, when the upper hold lock 31 firmly holds the roller bracket 64 of the upper roller unit 21 in the first closed position CP1, and the lower hold lock 32 firmly holds the roller bracket 64 of the lower roller unit 22 in the first closed position CP1, the vehicle door 5 may swing around the upper rotation axis CX1 of the upper roller unit 21 and the lower rotation axis CX2 of the lower roller unit 22. Thus, the vehicle door 5 may move between the second closed position CP2 in which the vehicle door 5 is closed and the second open position OP2 in which the vehicle door 5 is opened.

According to the exemplary embodiment illustrated in FIGS. 8 and 9, as the pivot pin 68*a* is located between the second end portion 62 of the body 60 and the vehicle door 5, the rotation axes CX1 and CX2 of the vehicle door 5 may be relatively close to the vehicle door 5. Since a rotation radius R2 of the vehicle door 5 is relatively shortened, a gap S2 between the vehicle door 5 and the other adjacent door 4 may be relatively reduced, resulting in improved exterior styling. Even though the rotation axes CX1 and CX2 of the vehicle door 5 are close to the vehicle door 5, a swing trajectory T2 of the vehicle door 5 is not reduced, and thus an open space created by the swing of the vehicle door 5 may not be narrowed.

Figure 11:
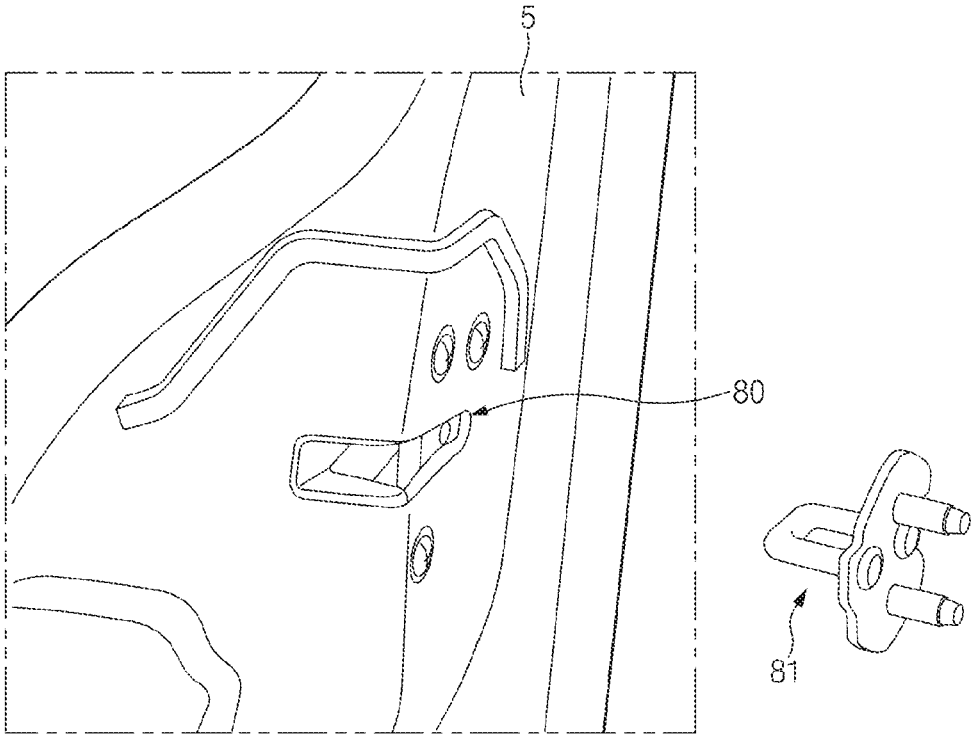
FIG. 11 illustrates a main latch mounted on a vehicle door and a main striker.

Referring to FIG. 11, a main latch 80 may be mounted on a rear end of the vehicle door 5, and a main striker 81 may be fixed to the vehicle body 1. The main latch 80 may releasably engage with the main striker 81. When the vehicle door 5 is in the first closed position CP1 or the second closed position CP2, the main latch 80 may engage with the main striker 81 by an engaging operation of the outside handle 6 so that the vehicle door 5 may be locked in the first closed position CP1 or the second closed position CP2. When the vehicle door 5 is in the first closed position CP1 or the second closed position CP2, the main latch 80 may release the main striker 81 by a release operation of the outside handle 6 so that the vehicle door 5 may be allowed to move in the sliding mode or the swing mode. When the vehicle door 5 is held in the first closed position CP1 and the main latch 80 releases the main striker 81, a center roller unit 23 may be released from the center rail 13, and thus the vehicle door 5 may be opened and closed in the swing mode.

The vehicle door opening and closing apparatus, according to exemplary embodiments of the present disclosure, may further include the center rail 13 mounted at a central portion of the vehicle body 1, and the center roller unit 23 guided along the center rail 13.

Referring to FIGS. 1 and 3, the center rail 13 may extend from a rear edge of the door aperture 3 in the longitudinal direction of the vehicle. The center roller unit 23 may be pivotally mounted at a central portion of the vehicle door 5. In particular, the center roller unit 23 may be mounted in a position adjacent to the rear end of the vehicle door 5. The center roller unit 23 may be guided along the center rail 13.

Figure 12:
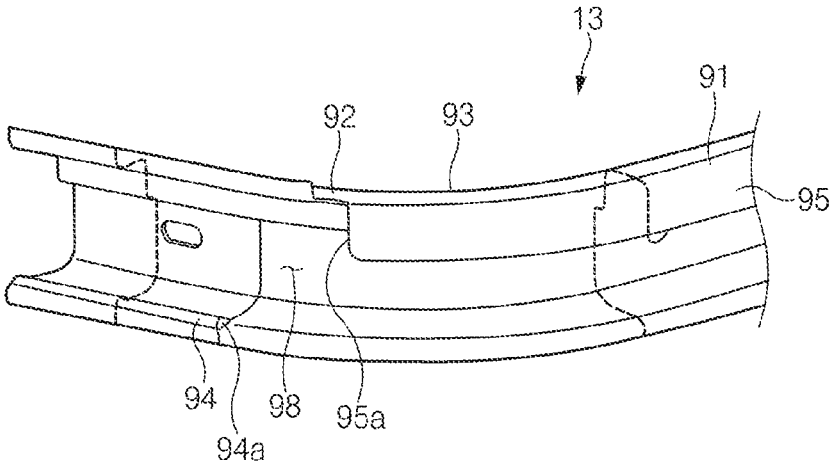
FIG. 12 illustrates a perspective view of a center rail in a vehicle door opening and closing apparatus according to an exemplary embodiment of the present disclosure.

Referring to FIG. 12, the center rail 13 may include a sliding guide 91 extending straightly in the longitudinal direction of the vehicle, and a swing guide 92 extending from the sliding guide 91 toward the interior side of the vehicle. The swing guide 92 may be bent at a predetermined angle with respect to the sliding guide 91 through a bending portion 93, and the bending portion 93 may be curved at a predetermined radius.

Figure 13:
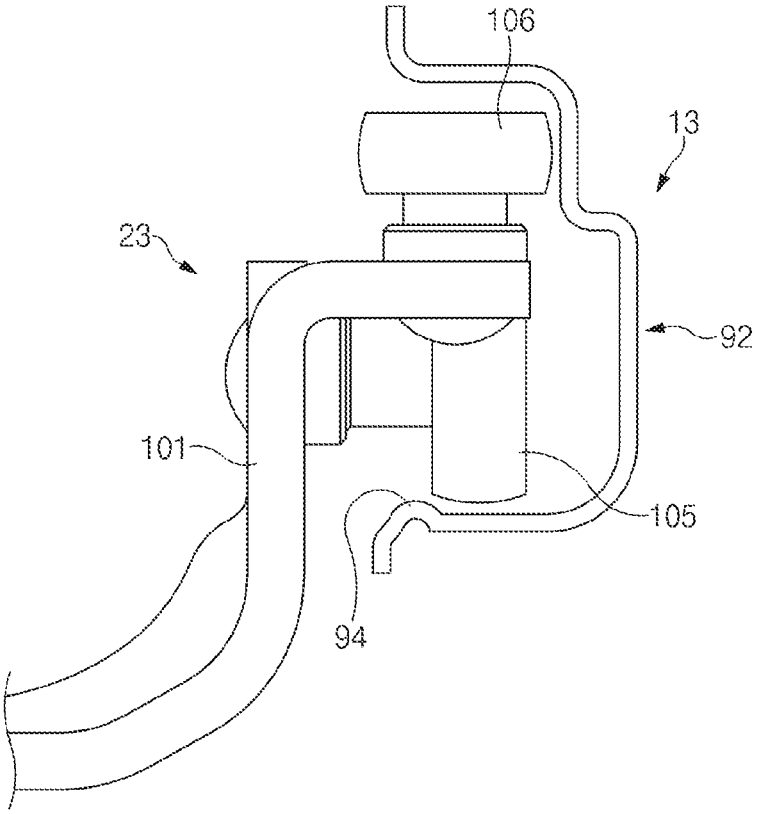
FIG. 13 illustrates a cross-sectional view of a swing guide of a center rail.
Figure 14:
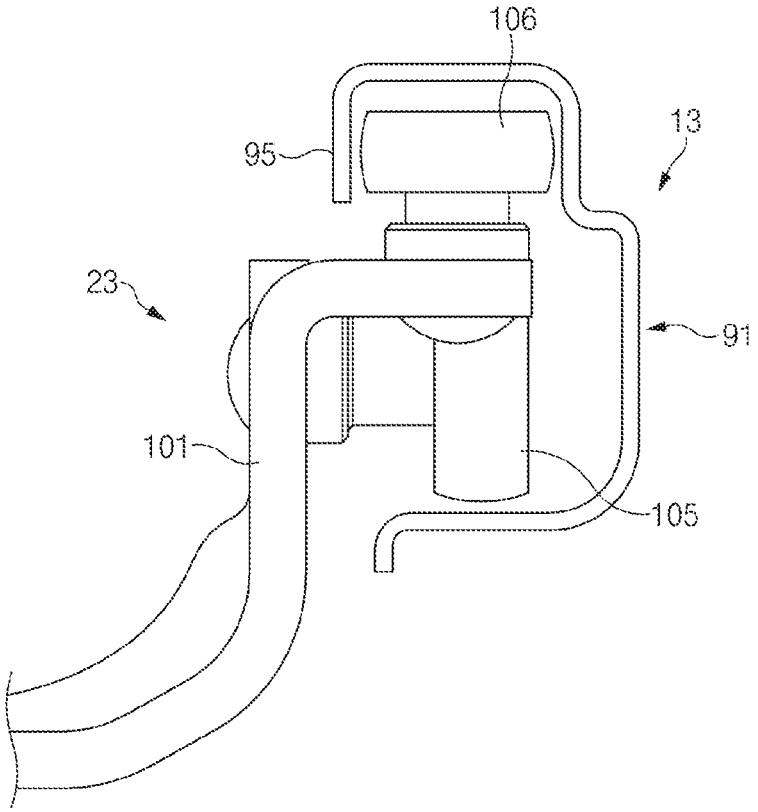
FIG. 14 illustrates a cross-sectional view of a sliding guide of a center rail.
Figure 15:
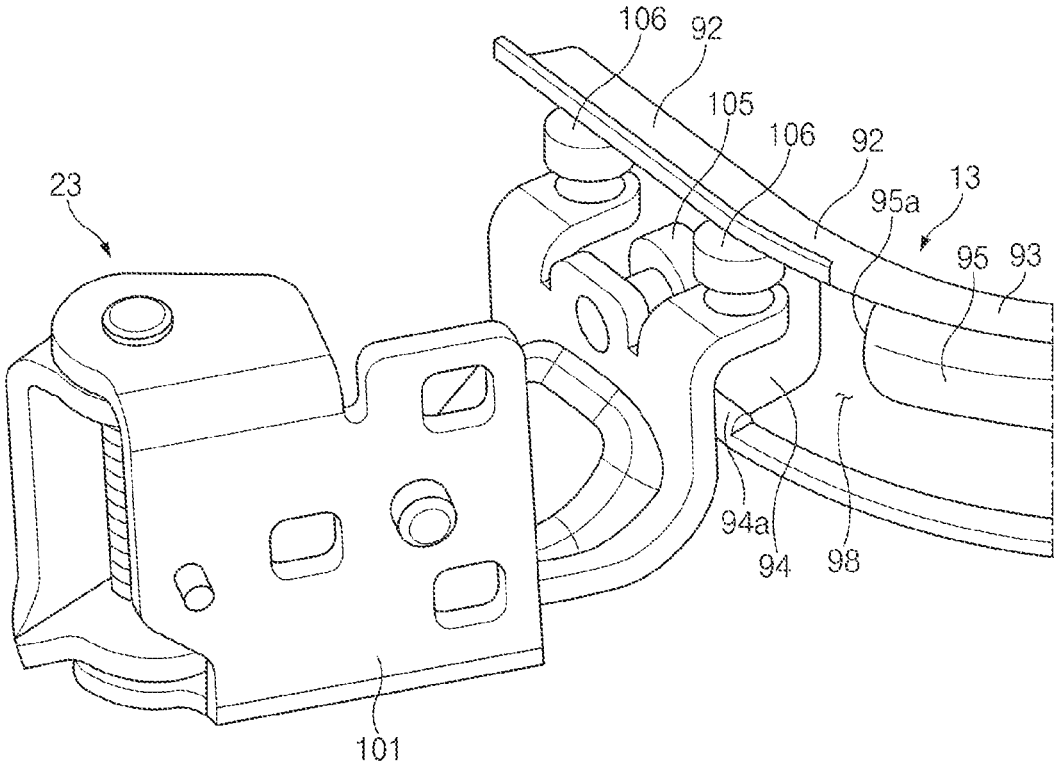
FIG. 15 illustrates a structure in which a center roller unit is held in a swing guide of a center rail.

Referring to FIGS. 13 to 15, the center roller unit 23 may include a roller bracket 101 and rollers 105 and 106 rotatably mounted on the roller bracket 101. The roller bracket 101 may be pivotally mounted at the central portion of the vehicle door 5. The rollers 105 and 106 may roll along the center rail 13. As illustrated in FIG. 15, a middle roller 105 and two side rollers 106 disposed on both sides of the middle roller 105 may be rotatably mounted on the roller bracket 101. A rotation axis of the middle roller 105 may be orthogonal to a rotation axis of the side roller 106.

When the vehicle door 5 slides in the longitudinal direction of the vehicle as the sliding mode is selected, the sliding guide 91 may guide the rollers 105 and 106 of the center roller unit 23.

Referring to FIGS. 12 and 14, the sliding guide 91 may include a stopper wall 95 preventing the rollers 105 and 106 of the center roller unit 23 from being separated from the sliding guide 91. The stopper wall 95 may extend along a length of the sliding guide 91 and a length of the bending portion 93. The stopper wall 95 may protrude vertically downward from the top of the sliding guide 91. As the stopper wall 95 closes an upper area of the sliding guide 91 and an upper area of the bending portion 93, the rollers 105 and 106 of the center roller unit 23 may be prevented from moving away from the sliding guide 91 toward the exterior side of the vehicle as illustrated in FIG. 14.

When the vehicle door 5 is opened and closed in the swing mode as the swing mode is selected, the swing guide 92 may guide the rollers 105 and 106 of the center roller unit 23 to be released from the center rail 13.

An exterior side of the swing guide 92 may be entirely opened toward the exterior of the vehicle. A guide projection 94 may protrude upwardly from the bottom of the swing guide 92, and the guide projection 94 may extend along a length of the swing guide 92. When the vehicle door 5 swings from the second closed position CP2 to the second open position OP2 along the swing trajectory T1 or T2, the middle roller 105 of the center roller unit 23 may be guided along the guide projection 94 as illustrated in FIG. 13.

Figure 16:
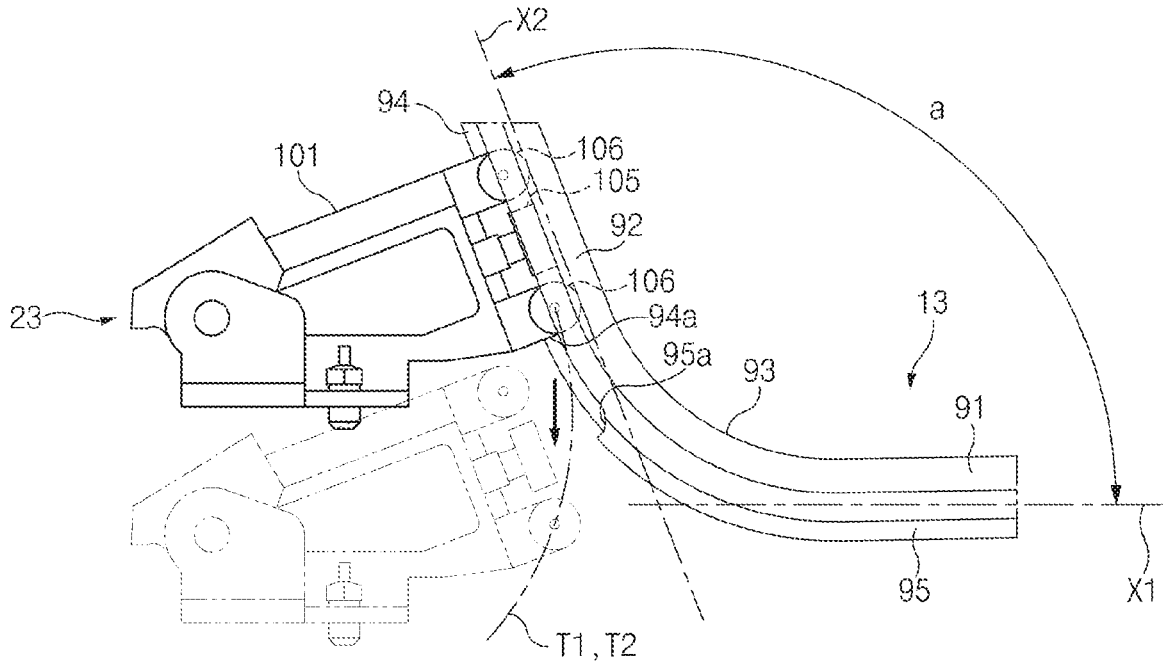
FIG. 16 illustrates an operation in which a center roller unit is released from a swing guide of a center rail.

A front end 95*a* of the stopper wall 95 of the sliding guide 91 and a rear end 94*a* of the guide projection 94 may be located so as not to interfere with the swing trajectories T1 and T2 of the vehicle door 5. In addition, as illustrated in FIG. 16, an axis X1 of the sliding guide 91 and an axis X2 of the swing guide 92 may intersect at a predetermined angle a. In particular, the angle a of intersection between the axis X1 of the sliding guide 91 and the axis X2 of the swing guide 92 may be an obtuse angle, so that the rollers 105 and 106 of the center roller unit 23 may easily be released from the swing guide 92 of the center rail 13 or may easily be received in the swing guide 92 of the center rail 13. The center rail 13 may include a space 98 allowing the rollers 105 and 106 of the center roller unit 23 to be released from the center rail 13 or be received in the center rail 13 when the vehicle door 5 swings in the swing mode. The space 98 may be defined between the front end 95*a* of the stopper wall 95 and the rear end 94*a* of the guide projection 94 as the front end 95*a* of the stopper wall 95 and the rear end 94*a* of the guide projection 94 are spaced apart from each other. Due to the space 98, there is no interference when the rollers 105 and 106 of the center roller unit 23 are released from the center rail 13 or are received in the center rail 13 in the swing mode.

Meanwhile, according to the exemplary embodiment illustrated in FIGS. 12 to 16, when malfunction of the main latch 80 or deformation of the vehicle door 5 or the swing guide 92 due to an external impact occurs in the sliding mode, the rollers 105 and 106 of the center roller unit 23 may be separated from the swing guide 92 of the center rail 13, and thus the vehicle door 5 may fail to be easily opened and closed in the sliding mode.

In order to deal with this problem, the vehicle door opening and closing apparatus, according to exemplary embodiments of the present disclosure, may be configured such that the rollers 105 and 106 of the center roller unit 23 may not be separated from the swing guide 92 of the center rail 13 in any mode of the sliding mode and the swing mode, and hinge elements 110 and 120 of the center roller unit 23 may be connected to or released from each other as either the sliding mode or the swing mode is selected. Thus, the vehicle door opening and closing apparatus may reliably open and close the vehicle door 5 in either the sliding mode or the swing mode.

Figure 21:
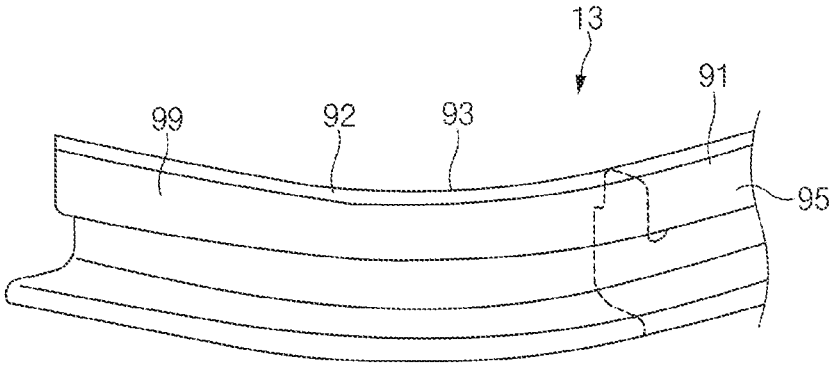
FIG. 21 illustrates a perspective view of a center rail in a vehicle door opening and closing apparatus according to another exemplary embodiment of the present disclosure.

Referring to FIG. 21, according to another exemplary embodiment, the swing guide 92 of the center rail 13 may have a stopper wall 99 extending from the stopper wall 95 of the sliding guide 91. The swing guide 92 may use the stopper wall 99 to prevent the rollers 105 and 106 of the center roller unit 23 from being separated from the center rail 13. Thus, the rollers 105 and 106 of the center roller unit 23 may not be separated from the center rail 13 in any mode of the swing mode and the sliding mode.

Referring to FIGS. 17 to 20, according to exemplary embodiments of the present disclosure, the center roller unit 23 may include a door-side hinge element 110 fixed to the vehicle door 5, a roller-side hinge element 120 connected to the roller bracket 101 of the center roller unit 23, and a slide hinge 130 releasably connecting the door-side hinge element 110 to the roller-side hinge element 120.

The door-side hinge element 110 may include a door-side base 115 fixed to the vehicle door 5 by using fasteners, welding, and/or the like, and a first door-side hinge arm in and a second door-side hinge arm 112 extending from the door-side base 115.

The first door-side hinge arm 111 may have a first door-side hinge hole 113, and the second door-side hinge arm 112 may have a second door-side hinge hole 114. The first door-side hinge arm in and the second door-side hinge arm 112 may be spaced apart from each other.

The roller-side hinge element 120 may be integrally connected to the roller bracket 101 of the center roller unit 23. In particular, the roller-side hinge element 120 may be integrally formed with the roller bracket 101 so that the roller-side hinge element 120 and the roller bracket 101 may form a unitary one-piece structure.

The roller-side hinge element 120 may include a roller-side base 125 integrally connected to the roller bracket 101 of the center roller unit 23, and a first roller-side hinge arm 121 and a second roller-side hinge arm 122 extending from the roller-side base 125. The first roller-side hinge arm 121 may have a first roller-side hinge hole 123, and the second roller-side hinge arm 122 may have a second roller-side hinge hole 124. The first roller-side hinge arm 121 and the second roller-side hinge arm 122 may be spaced apart from each other.

The first door-side hinge arm in of the door-side hinge element 110 may be adjacent to or contact the first roller-side hinge arm 121 of the roller-side hinge element 120, and an axis of the first door-side hinge hole 113 may be aligned with an axis of the first roller-side hinge hole 123. The second door-side hinge arm 112 of the door-side hinge element 110 may be adjacent to or contact the second roller-side hinge arm 122 of the roller-side hinge element 120, and an axis of the second door-side hinge hole 114 may be aligned with an axis of the second roller-side hinge hole 124. A virtual axis which virtually extends along the axis of the first door-side hinge hole 113 and the axis of the first roller-side hinge hole 123 may be parallel to or be aligned with a virtual axis which virtually extends along the axis of the second door-side hinge hole 114 and the axis of the second roller-side hinge hole 124.

The slide hinge 130 may include a base 135 movably mounted, a first extension portion 131 extending horizontally from a top end of the base 135 toward the first door-side hinge arm in and the first roller-side hinge arm 121, a second extension portion 132 extending horizontally from a bottom end of the base 135 toward the second door-side hinge arm 112 and the second roller-side hinge arm 122, a first hinge pin 133 extending vertically from the first extension portion 131, and a second hinge pin 134 extending vertically from the second extension portion 132.

The first hinge pin 133 may be releasably inserted into the first door-side hinge hole 113 and the first roller-side hinge hole 123, and the second hinge pin 134 may be releasably inserted into the second door-side hinge hole 114 and the second roller-side hinge hole 124.

The base 135 may move linearly with respect to the door-side hinge element 110 and the roller-side hinge element 120, and the base 135 may move linearly along an axis of the base 135. In particular, the axis of the base 135 may be parallel to the axis of the first door-side hinge hole 113, the axis of the second door-side hinge hole 114, the axis of the first roller-side hinge hole 123, and the axis of the second roller-side hinge hole 124, and thus a movement path of the base 135 may be parallel to the axis of the first door-side hinge hole 113, the axis of the second door-side hinge hole 114, the axis of the first roller-side hinge hole 123, and the axis of the second roller-side hinge hole 124.

The base 135 may be moved by a driving unit 150, and the driving unit 150 may include a driving motor 151, a pinion 152 coupled to a driving shaft of the driving motor 151, and rack teeth 153 meshing with the pinion 152. The rack teeth 153 may be arranged in a longitudinal direction of the base 135. As the driving motor 151 rotates, the rotation of the pinion 152 may be delivered to the rack teeth 153, and thus the base 135 may move linearly.

The slide hinge 130 may move between a connection position (see FIG. 18) in which the door-side hinge element 110 and the roller-side hinge element 120 are connected to each other and a release position (see FIGS. 19 and 20) in which the door-side hinge element 110 and the roller-side hinge element 120 are released from each other.

Figure 18:
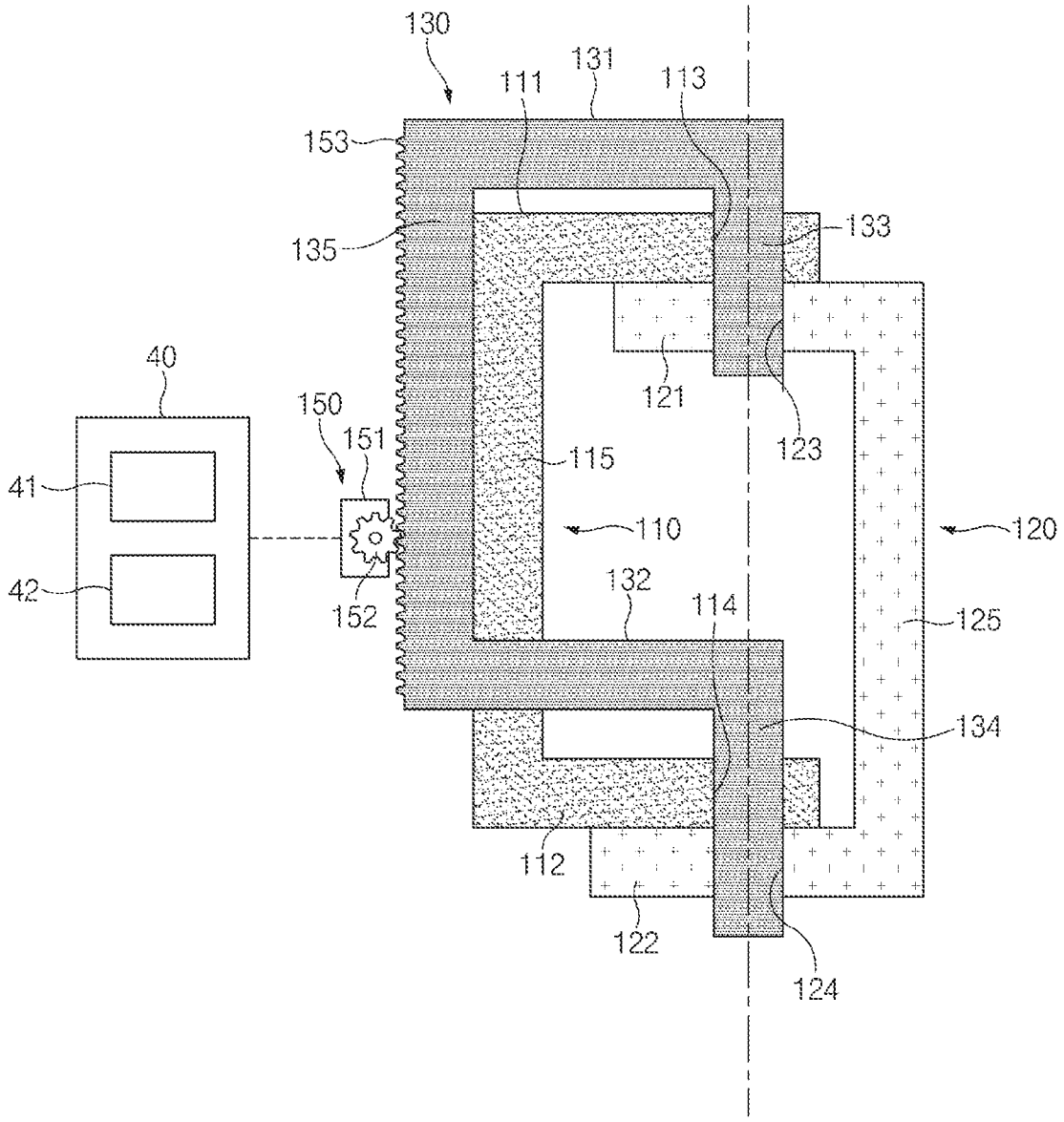
FIG. 18 illustrates a state of a center roller unit in which a door-side hinge element and a roller-side hinge element are connected by a slide hinge in a vehicle door opening and closing apparatus according to an exemplary embodiment of the present disclosure.

Referring to FIG. 18, when the slide hinge 130 is in the connection position, the first hinge pin 133 of the slide hinge 130 may be inserted into the first door-side hinge hole 113 of the door-side hinge element 110 and the first roller-side hinge hole 123 of the roller-side hinge element 120, and the second hinge pin 134 of the slide hinge 130 may be inserted into the second door-side hinge hole 114 of the door-side hinge element 110 and the second roller-side hinge hole 124 of the roller-side hinge element 120. The roller-side hinge element 120 may be pivotally connected to the door-side hinge element 110 by the slide hinge 130. The center roller unit 23 may be configured such that the roller-side hinge element 120 may be pivotally connected to the door-side hinge element 110, and thus the vehicle door 5 may be easily opened and closed in the sliding mode.

Figure 19:
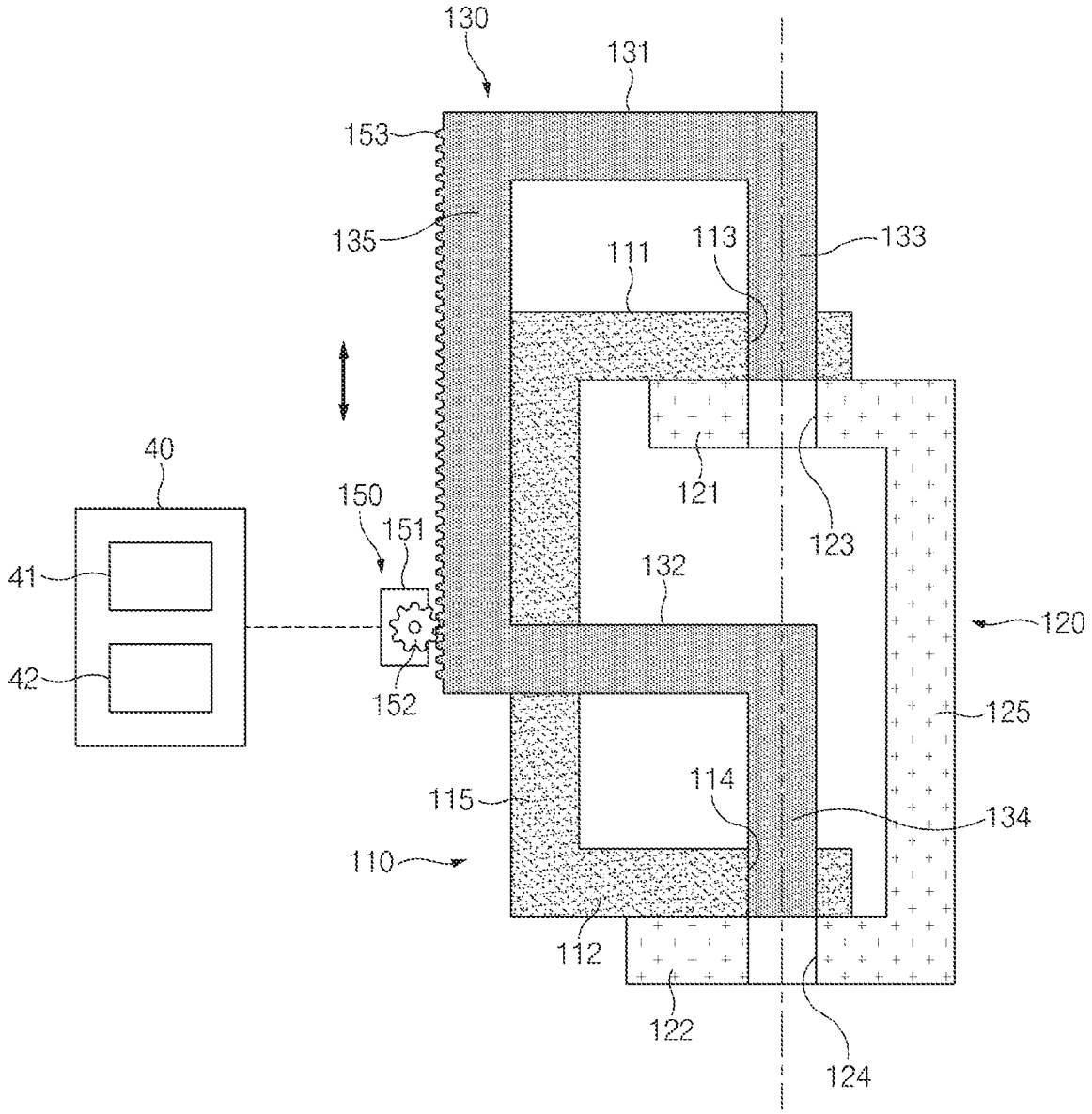
FIG. 19 illustrates a state in which the slide hinge moves with respect to the door-side hinge element and the roller-side hinge element in the center roller unit illustrated in FIG. 18.
Figure 20:
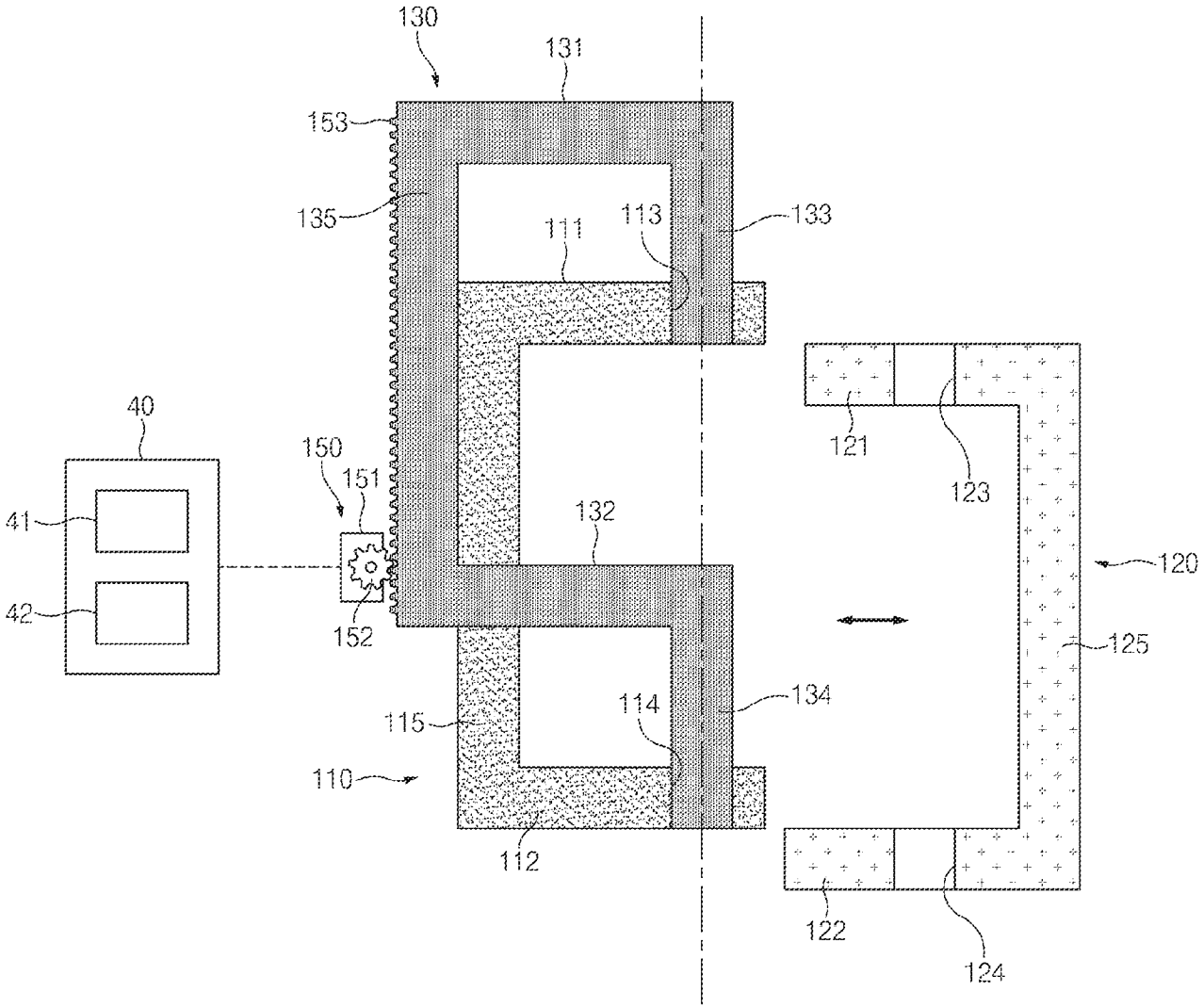
FIG. 20 illustrates a state in which the roller-side hinge element is released from the door-side hinge element in the center roller unit illustrated in FIG. 19.

Referring to FIG. 19, when the slide hinge 130 is in the release position, the first hinge pin 133 of the slide hinge 130 may be released from the first roller-side hinge hole 123 of the roller-side hinge element 120, and the second hinge pin 134 of the slide hinge 130 may be released from the second roller-side hinge hole 124 of the roller-side hinge element 120. In this state, the roller-side hinge element 120 may be released from the door-side hinge element 110 as illustrated in FIG. 20. The center roller unit 23 may be configured such that the roller-side hinge element 120 may be released from the door-side hinge element 110, and thus the vehicle door 5 may be easily opened and closed in the swing mode.

The vehicle body may have a door frame **3*a* defining the door aperture 3. The center roller unit 23 according to exemplary embodiments of the present disclosure may be releasably connected to the door frame 3*a* by a grip unit 140**.

The roller-side hinge element 120 may be releasably connected to the door frame **3*a* by the grip unit 140**.

Figure 24:
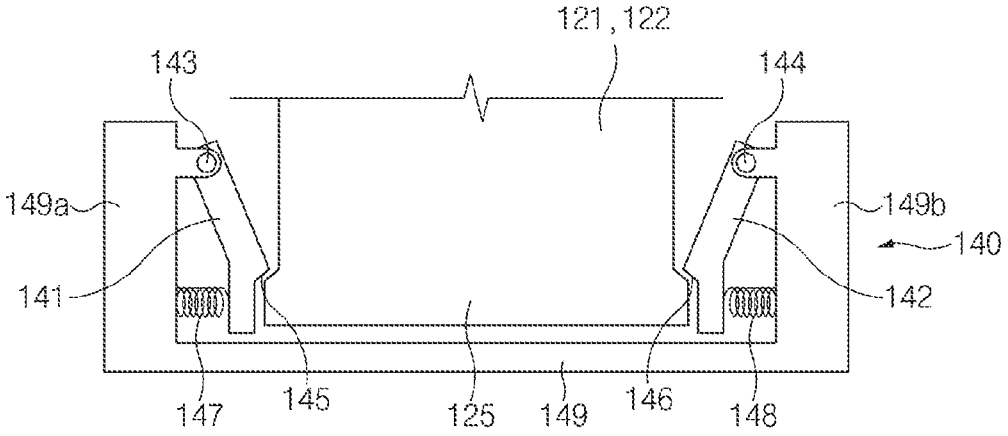
FIG. 24 illustrates a grip unit of the center roller unit illustrated in FIG. 17.

Referring to FIG. 24, according to an exemplary embodiment, the grip unit 140 may include a housing 149 fixed to the door frame **3*a* by welding, using fasteners, and/or the like, a first grip member 141 pivotally mounted on the housing 149, and a second grip member 142 pivotally mounted on the housing 149**.

The housing 149 may receive the roller-side base 125 and at least portions of the roller-side hinge arms 121 and 122 of the roller-side hinge element 120. The housing 149 may have a first sidewall **149*a* and a second sidewall 149*b*, and the first sidewall 149*a* and the second sidewall 149*b* may be spaced apart from each other to receive the roller-side base 125 and the roller-side hinge arms 121 and 122 of the roller-side hinge element 120**.

The first grip member 141 and the second grip member 142 may be arranged to face each other and be spaced apart from each other by a gap corresponding to a width of the roller-side base 125 of the roller-side hinge element 120.

The first grip member 141 may be pivotally mounted on the first sidewall 149*a* of the housing 149 by a first pivot pin 143, and the first grip member 141 may be biased toward the center of the housing 149 by a first biasing element 147. The first biasing element 147 may be spaced apart from the first pivot pin 143 in a longitudinal direction of the first sidewall 149*a*, and the first biasing element 147 may be a coil spring interposed between the first sidewall 149*a* and the first grip member 141.

The second grip member 142 may be pivotally mounted on the second sidewall 149*b* of the housing 149 by a second pivot pin 144, and the second grip member 142 may be biased toward the center of the housing 149 by a second biasing element 148. The second biasing element 148 may be spaced apart from the second pivot pin 144 in a longitudinal direction of the second sidewall 149*b*, and the second biasing element 148 may be a coil spring interposed between the second sidewall 149*b* and the second grip member 142.

The first grip member 141 and the second grip member 142 may grip both opposing edges of the roller-side base 125 by a biasing force of the first biasing element 147 and a biasing force of the second biasing element 148.

The first grip member 141 may have a first engaging shoulder 145 with which a corresponding edge of the roller-side base 125 engages, and the second grip member 142 may have a second engaging shoulder 146 with which a corresponding edge of the roller-side base 125 engages.

When a force applied by the user to the roller-side base 125 of the roller-side hinge element 120 is greater than the forces of the biasing elements 147 and 148, the roller-side base 125 of the roller-side hinge element 120 may be released from the first and second grip members 141 and 142. That is, the grip unit 140 may release the roller-side hinge element 120.

Figure 17:
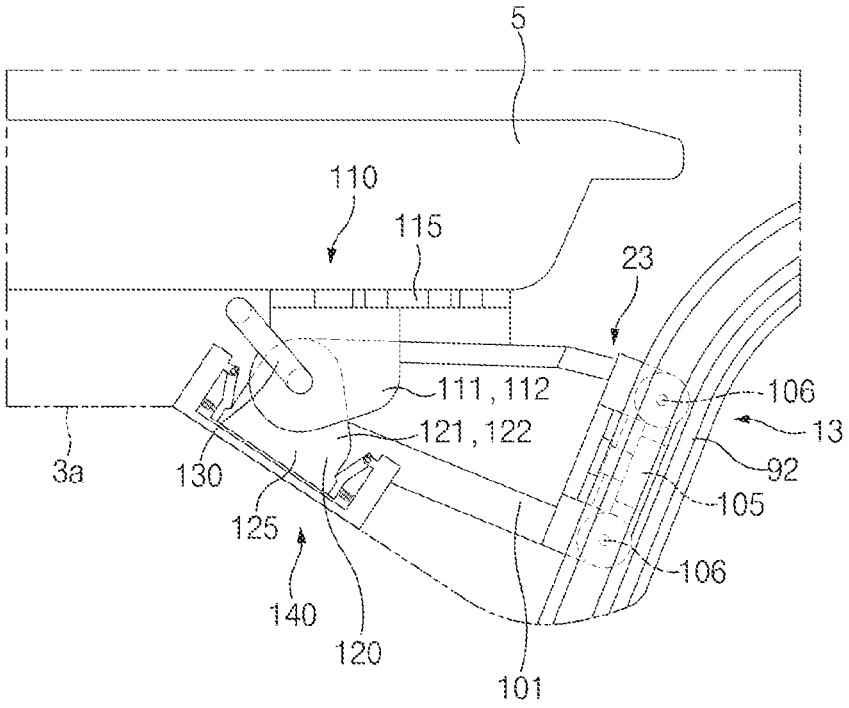
FIG. 17 illustrates a structure in which a center roller unit is disposed between a vehicle door and a center rail in a vehicle door opening and closing apparatus according to an exemplary embodiment of the present disclosure.

Referring to FIG. 17, in a state in which the door-side hinge element 110 is connected to the roller-side hinge element 120 by the slide hinge 130 moving to the connection position (see FIG. 18), the roller-side hinge element 120 may be connected to the door frame 3*a* by the grip unit 140 so that the vehicle door 5 may be kept in a closed state.

Figure 22:
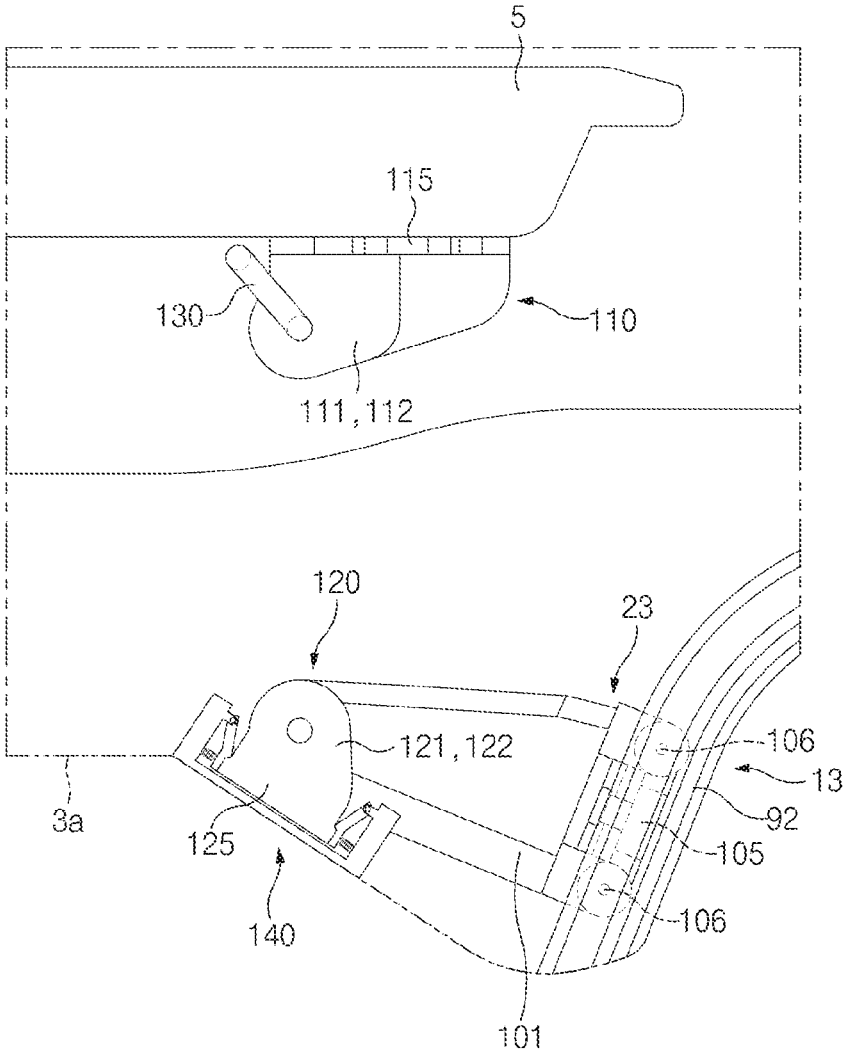
FIG. 22 illustrates a state in which the door-side hinge element is released from the roller-side hinge element in the center roller unit illustrated in FIG. 17.

Referring to FIG. 22, as the slide hinge 130 moves to the release position (see FIG. 20) in a state in which the roller-side hinge element 120 is connected to the door frame 3*a* by the grip unit 140, the door-side hinge element 110 may be released from the roller-side hinge element 120, and thus the vehicle door 5 may be allowed to swing toward the exterior space of the vehicle. That is, the door-side hinge element 110 may be released from the roller-side hinge element 120 so that the vehicle door 5 may be opened and closed in the swing mode.

Figure 23:
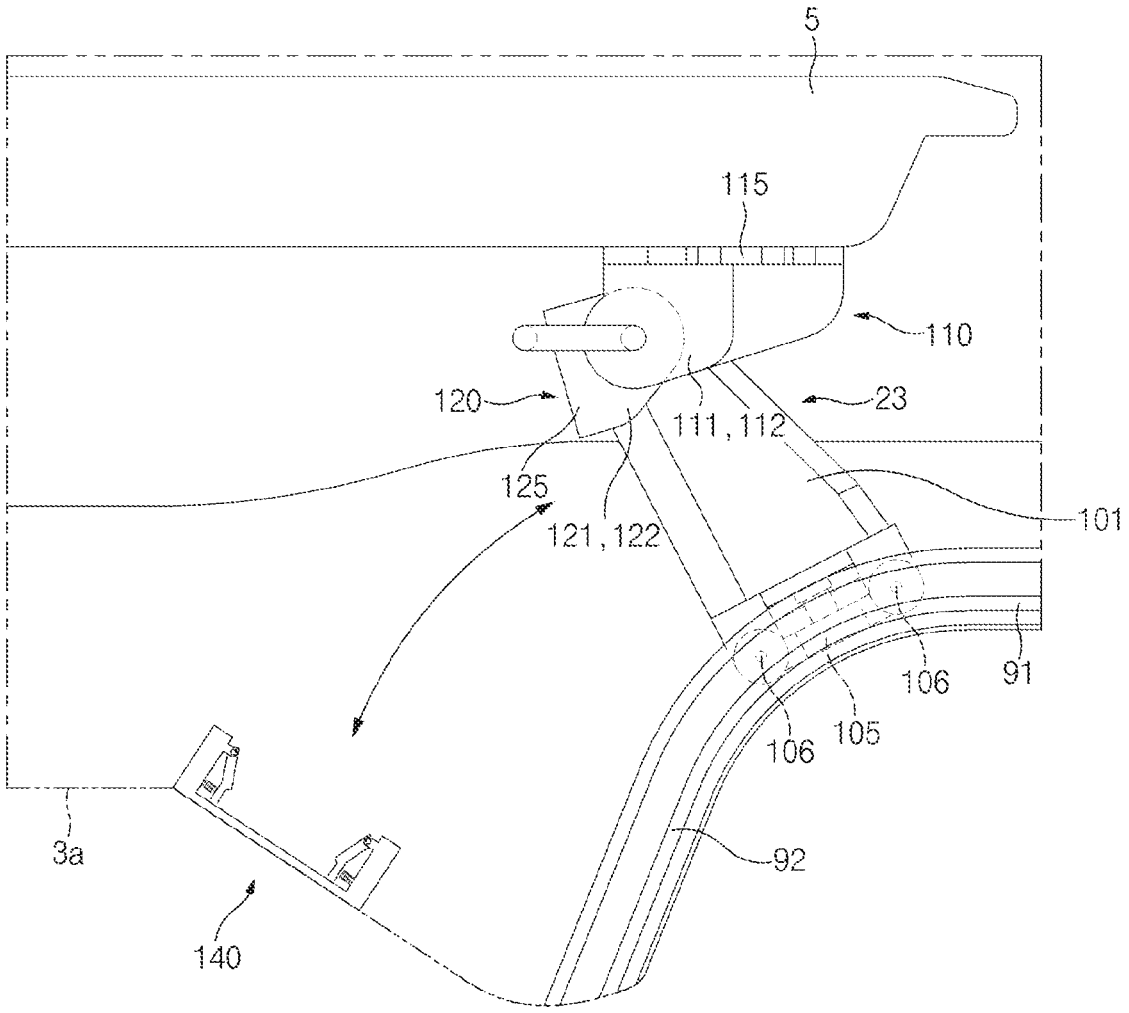
FIG. 23 illustrates a state in which the door-side hinge element is connected to the roller-side hinge element, and the roller-side hinge element is released from a grip unit in the center roller unit illustrated in FIG. 17.

Referring to FIG. 23, as the slide hinge 130 moves to the connection position (see FIG. 18), the door-side hinge element 110 may be connected to the roller-side hinge element 120. In this state, when the user pushes the vehicle door 5 toward the rear of the vehicle, the rollers 105 and 106 of the center roller unit 23 may move toward the sliding guide 91 of the center rail 13. Here, when the force applied by the user to the roller-side hinge element 120 is greater than the forces of the biasing elements 147 and 148, the roller-side base 125 of the roller-side hinge element 120 may be released from the pair of grip members 141 and 142.

Figure 25:
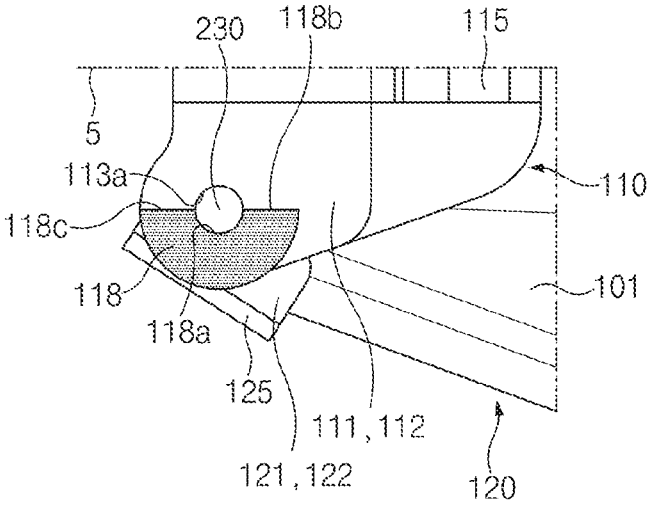
FIG. 25 illustrates a state of a center roller unit in which a door-side hinge element and a roller-side hinge element are connected by a hinge lug in a vehicle door opening and closing apparatus according to an exemplary embodiment of the present disclosure.
Figure 26:
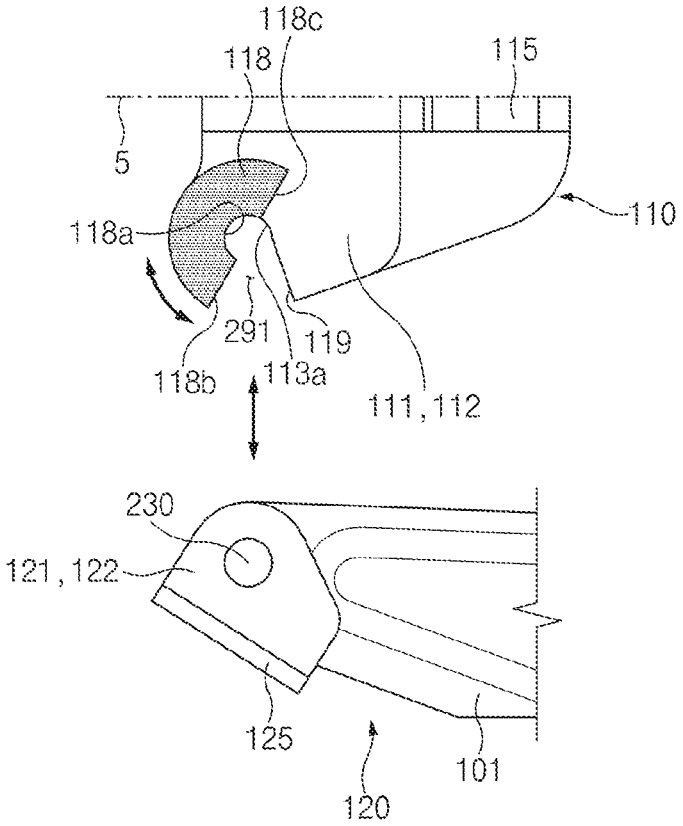
FIG. 26 illustrates a state in which the roller-side hinge element and the door-side hinge element are released by the hinge lug in the center roller unit illustrated in FIG. 25.

FIGS. 25 and 26 illustrate a hinge structure of the center roller unit 23 according to another exemplary embodiment of the present disclosure. Referring to FIGS. 25 and 26, a hinge pin 230 may be mounted between the roller-side hinge arms 121 and 122 of the roller-side hinge element 120, and the door-side hinge element 110 may be releasably connected to the hinge pin 230 by a pair of hinge lugs 118.

The door-side hinge element 110 may have a first recess 113*a* receiving a portion of the hinge pin 230, and the first recess 113*a* may be provided in each of the door-side hinge arms in and 112. Each first recess 113*a* may have a radius corresponding to an outer diameter of the hinge pin 230. In particular, the first recess 113*a* may have an arc shape allowing the hinge pin 230 to be released. The door-side hinge arms in and 112 may have a first inclined surface 119 extending obliquely from the first recess 113*a*.

Each hinge lug 118 may have an arc shape, and the hinge lug 118 may be movably disposed on each of the door-side hinge arms in and 112 of the door-side hinge element 110. In particular, the hinge lug 118 may be mounted to move along a circular path, which is defined by the circumference of the first recess 113*a*, by a driving means (not shown) including a driving motor (not shown). The hinge lug 118 may have a second recess 118*a* receiving a portion of the hinge pin 230. The second recess 118*a* may have a radius corresponding to the outer diameter of the hinge pin 230, and the second recess 118*a* may have an arc shape allowing the hinge pin 230 to be released. The hinge lug 118 may have a first end surface 118*b* and a second end surface 118*c*.

The hinge lug 118 may move between a hold position (see FIG. 25) in which the hinge lug 118 holds the hinge pin 230 and a release position (see FIG. 26) in which the hinge lug 118 allows the hinge pin 230 to be released.

As illustrated in FIG. 25, when the hinge lug 118 is in the hold position, the second recess 118*a* of the hinge lug 118 may be continuous with respect to the first recess 113*a* of the door-side hinge element 110 in a circumferential direction so that the first recess 113*a* and the second recess 118*a* may define a closed hinge hole. As the hinge pin 230 is held in the closed hinge hole defined by the first recess 113*a* and the second recess 118*a*, the door-side hinge element 110 may be pivotally connected to the roller-side hinge element 120 by the hinge pin 230. The closed hinge hole in this disclosure refers to a hole completely surrounded by the first recess 113*a* and the second recess 118*a*.

As illustrated in FIG. 26, when the hinge lug 118 is in the release position, the first end surface 118*b* of the hinge lug 118 may be spaced apart from the first inclined surface 119 of the door-side hinge element 110 so that a space 291 allowing the movement of the hinge pin 230 may be formed between the first end surface 11813, of the hinge lug 118 and the first inclined surface 119 of the door-side hinge element 110. As the second recess 118*a* of the hinge lug 118 is not continuous with respect to the first recess 113*a* of the door-side hinge element 110 in the circumferential direction but is spaced apart from the first recess 113*a* of the door-side hinge element 110, the first recess 113*a* and the second recess 118*a* may form an open hinge hole. As the hinge pin 230 is released through the space 291 of the open hinge hole, the door-side hinge element 110 may be released from the roller-side hinge element 120.

Figure 27:
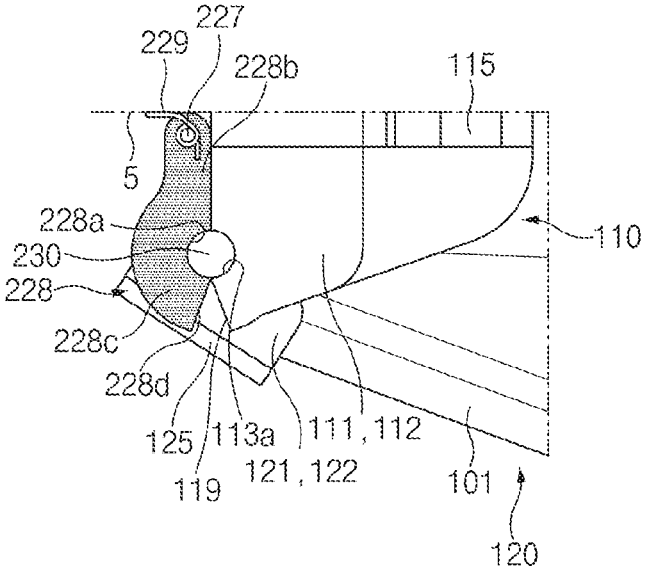
FIG. 27 illustrates a state of a center roller unit in which a door-side hinge element and a roller-side hinge element are connected by a hinge lug in a vehicle door opening and closing apparatus according to an exemplary embodiment of the present disclosure.
Figure 28:
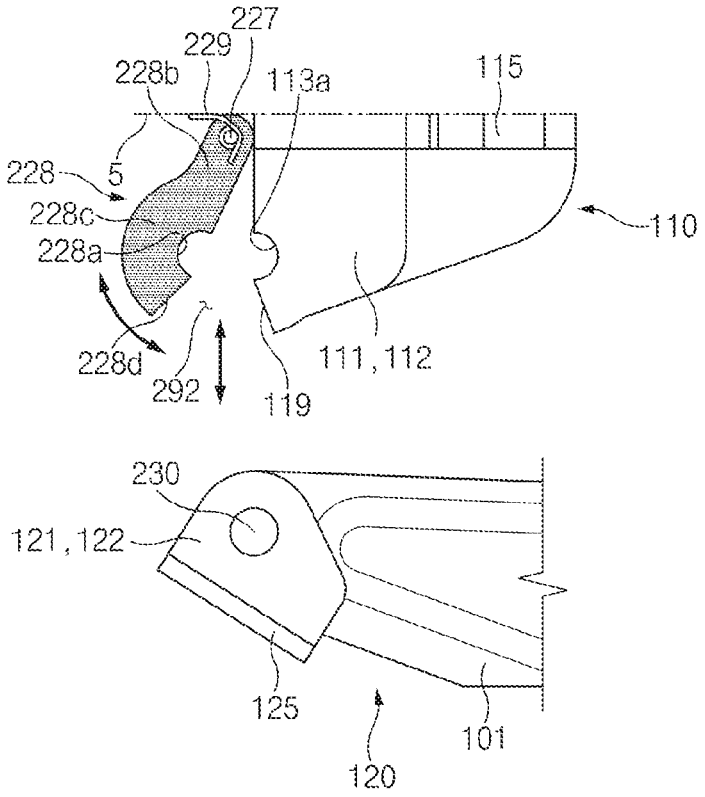
FIG. 28 illustrates a state in which the roller-side hinge element and the door-side hinge element are released by the hinge lug in the center roller unit illustrated in FIG. 27.

FIGS. 27 and 28 illustrate a hinge structure of the center roller unit 23 according to another exemplary embodiment of the present disclosure. Referring to FIGS. 27 and 28, the door-side hinge element 110 may be releasably connected to the hinge pin 230 of the roller-side hinge element 120 by a pair of hinge lugs 228.

Each hinge lug 228 may include a first portion 228*b* pivotally mounted on each of the door-side hinge arms in and 112 of the door-side hinge element 110 by a pivot pin 227, and a second portion 228*c* having a second recess 228*a* receiving a portion of the hinge pin 230.

Each hinge lug 228 may be biased toward the door-side hinge element 110 by a biasing element 229. The biasing element 229 may be a torsion spring disposed around the pivot pin 227.

The second recess 228*a* may have a radius corresponding to the outer diameter of the hinge pin 230, and the second recess 228*a* may have an arc shape allowing the hinge pin 230 to be released.

The hinge lug 228 may have a second inclined surface 228*d* opposite to the first inclined surface 119 of the door-side hinge element 110, and the second inclined surface 228*d* may extend obliquely at a free end of the second portion 228*c*. For example, as illustrated in FIGS. 27 and 28, the first inclined surface 119 and the second inclined surface 228*d* may be symmetrical to each other with respect to the hinge pin 230.

The hinge lug 228 may move between a hold position (see FIG. 27) in which the hinge lug 228 holds the hinge pin 230 and a release position (see FIG. 28) in which the hinge lug 228 allows the hinge pin 230 to be released. The hinge lug 228 may be biased toward the hold position (see FIG. 27) by the biasing element 229. When the user opens the vehicle door 5 in the swing mode, and a force applied to the door-side hinge element 110 is greater than a biasing force of the biasing element 229, the hinge lug 228 may move to the release position (see FIG. 28).

As illustrated in FIG. 27, when the hinge lug 228 is in the hold position, the second recess 228*a* of the hinge lug 228 may be continuous with respect to the first recess 113*a* of the door-side hinge element 110 in the circumferential direction so that the first recess 113*a* and the second recess 228*a* may define a closed hinge hole. The closed hinge hole in this disclosure refers to a hole completely surrounded by the first recess 113*a* and the second recess 228*a*. As the hinge pin 230 is held in the closed hinge hole defined by the first recess 113*a* and the second recess 228*a*, the door-side hinge element 110 may be pivotally connected to the roller-side hinge element 120 by the hinge pin 230.

As illustrated in FIG. 28, when the hinge lug 228 is in the release position, the second inclined surface 228*d* of the hinge lug 228 may get farther away from the first inclined surface 119 of the door-side hinge element 110 so that a space 292 allowing the movement of the hinge pin 230 may be formed between the second inclined surface 228*d* of the hinge lug 228 and the first inclined surface 119 of the door-side hinge element 110. As the second recess 228*a* of the hinge lug 228 is not continuous with respect to the first recess 113*a* of the door-side hinge element 110 in the circumferential direction but is spaced apart from the first recess 113*a* of the door-side hinge element 110, the first recess 113*a* and the second recess 228*a* may form an open hinge hole. The open hinge hole in this disclosure refers to a C-shaped hole which is not completely surrounded by the first recess 113*a* and the second recess 228*a*. As the hinge pin 230 is released through the open hinge hole, the door-side hinge element 110 may be released from the roller-side hinge element 120.

When the user closes the vehicle door 5 in the swing mode in a state in which the door-side hinge element 110 is released from the roller-side hinge element 120, and the force applied to the hinge lug 228 by the hinge pin 230 of the roller-side hinge element 120 is greater than the force of the biasing element 229, the hinge pin 230 may push the second inclined surface 228*d* of the hinge lug 228 and the second inclined surface 228*d* of the hinge lug 228 may get farther away from the first inclined surface 119 of the door-side hinge element 110. The hinge pin 230 may be inserted into the first recess 113*a* of the door-side hinge element 110 and the second recess 228*a* of the hinge lug 228, and then the hinge lug 228 may hold the hinge pin 230 of the roller-side hinge element 120 by the biasing element 229.

Figure 29:
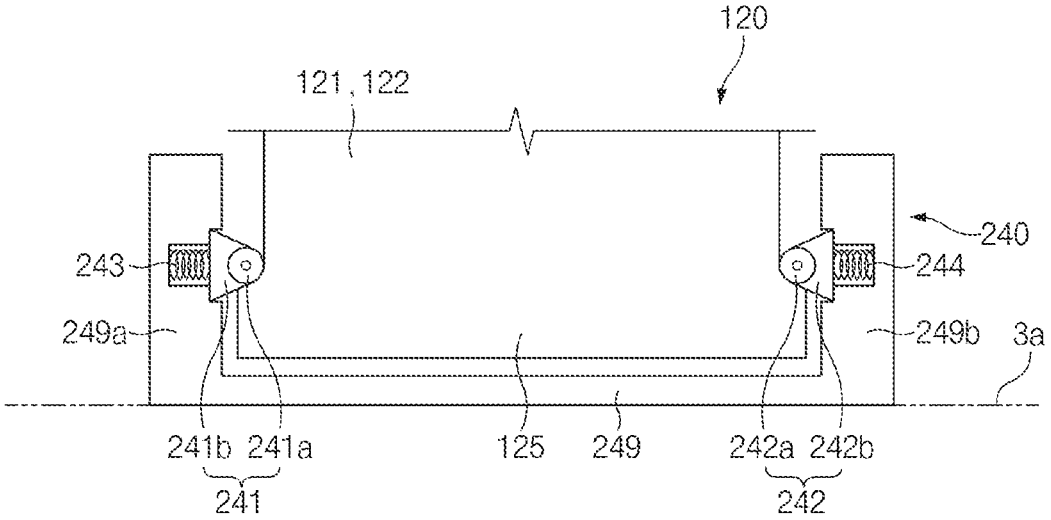
FIG. 29 illustrates a grip unit according to another exemplary embodiment of the present disclosure.

FIG. 29 illustrates a grip unit 240 according to another exemplary embodiment of the present disclosure. Referring to FIG. 29, the grip unit 240 may include a housing 249 fixed to the door frame 3*a* by welding, using fasteners, and/or the like, a first grip member 241 slidably mounted on a first sidewall 249*a* of the housing 249, and a second grip member 242 slidably mounted on a second sidewall 249*b* of the housing 249.

The housing 249 may receive the roller-side base 125 and at least portions of the roller-side hinge arms 121 and 122 of the roller-side hinge element 120. The housing 249 may have the first sidewall 249*a* and the second sidewall 249*b*, and the first sidewall 249*a* and the second sidewall 249*b* may be spaced apart from each other to receive the roller-side base 125 and the roller-side hinge arms 121 and 122 of the roller-side hinge element 120.

The first grip member 241 and the second grip member 242 may be arranged to face each other and be spaced apart from each other by a gap corresponding to the width of the roller-side base 125 of the roller-side hinge element 120.

The first grip member 241 may include a first roller 241*a* and a first roller support 241*b* supporting the first roller 241*a*. The first grip member 241 may be biased toward the center of the housing 249 by a first biasing element 243. The first sidewall 249*a* of the housing 249 may have a recess in which the first biasing element 243 is mounted, and the first biasing element 243 may push the first grip member 241 toward the center of the housing 249.

The second grip member 242 may include a second roller 242*a* and a second roller support 242*b* supporting the second roller 242*a*. The second grip member 242 may be biased toward the center of the housing 249 by a second biasing element 244. The second sidewall 249*b* of the housing 249 may have a recess in which the second biasing element 244 is mounted, and the second biasing element 244 may push the second grip member 242 toward the center of the housing 249.

The first grip member 241 and the second grip member 242 may grip both opposing edges of the roller-side base 125 by a biasing force of the first biasing element 243 and a biasing force of the second biasing element 244.

When a force applied to the roller-side base 125 of the roller-side hinge element 120 is greater than the forces of the biasing elements 243 and 244, the roller-side base 125 of the roller-side hinge element 120 may be released from the first and second grip members 241 and 242.

Figure 30:
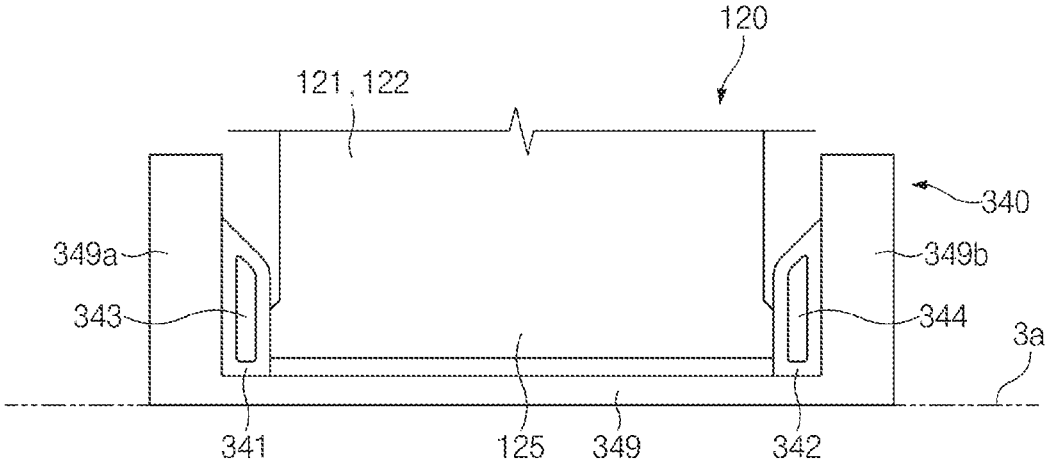
FIG. 30 illustrates a grip unit according to another exemplary embodiment of the present disclosure.

FIG. 30 illustrates a grip unit 340 according to another exemplary embodiment of the present disclosure. Referring to FIG. 30, the grip unit 340 may include a housing 349 fixed to the door frame 3*a* by welding, using fasteners, and/or the like, a first grip member 341 fixedly mounted on a first sidewall 349*a* of the housing 349, and a second grip member 342 fixedly mounted on a second sidewall 349*b* of the housing 349.

The housing 349 may receive the roller-side base 125 and at least portions of the roller-side hinge arms 121 and 122 of the roller-side hinge element 120. The housing 349 may have the first sidewall 349*a* and the second sidewall 349*b*, and the first sidewall 349*a* and the second sidewall 349*b* may be spaced apart from each other to receive the roller-side base 125 and the roller-side hinge arms 121 and 122 of the roller-side hinge element 120.

The first grip member 341 and the second grip member 342 may be arranged to face each other and be spaced apart from each other by a gap corresponding to the width of the roller-side base 125 of the roller-side hinge element 120.

The first grip member 341 may be made of a synthetic resin material such as polyacetal, polyoxymethylene (POM), and may have a first closed cavity 343 therein. The first grip member 341 may elastically press the roller-side base 125 of the roller-side hinge element 120 by the first closed cavity 343.

The second grip member 342 may be made of a synthetic resin material such as polyacetal, polyoxymethylene (POM), and may have a second closed cavity 344 therein. The second grip member 342 may elastically press the roller-side base 125 of the roller-side hinge element 120 by the second closed cavity 344.

The first grip member 341 and the second grip member 342 may grip both opposing edges of the roller-side base 125 by an elastic force thereof.

When a force applied to the roller-side base 125 of the roller-side hinge element 120 is greater than the elastic force of the first and second grip members 341 and 342, the roller-side base 125 of the roller-side hinge element 120 may be released from the first and second grip members 341 and 342.

FIGS. 1 to 30 illustrate the vehicle door opening and closing apparatus according to exemplary embodiments of the present disclosure applied to the rear door 5. However, the vehicle door opening and closing apparatus according to exemplary embodiments of the present disclosure may be applied to various vehicle doors, such as front doors, in addition to rear doors.

Figure 31:
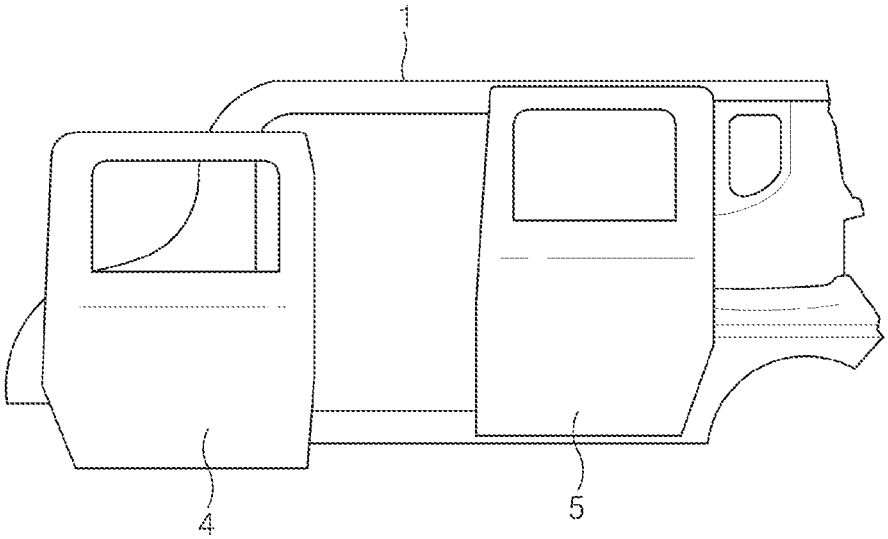
FIG. 31 illustrates a vehicle door opening and closing apparatus according to an exemplary embodiment of the present disclosure, which is applied to a front door of a vehicle, in a state in which the front door is opened in a sliding mode.
Figure 32:
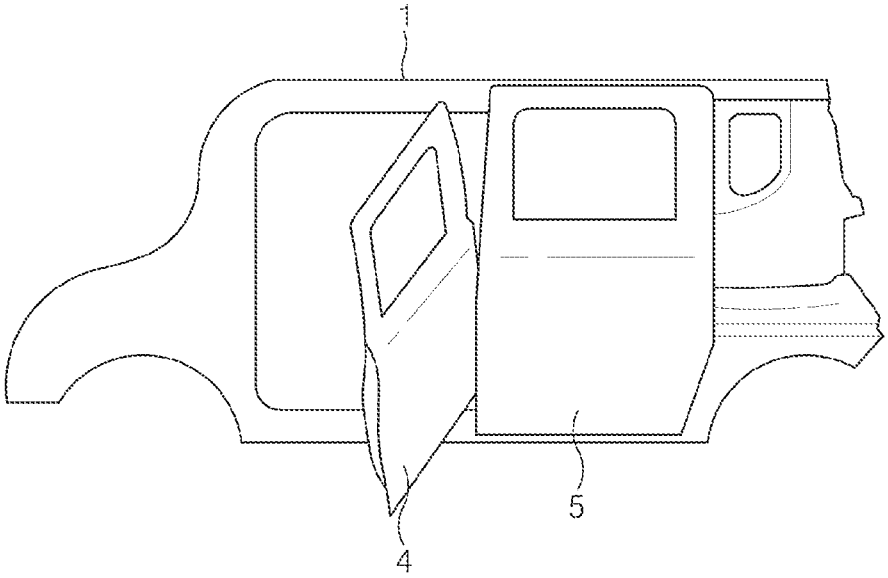
FIG. 32 illustrates a state in which the front door of FIG. 31 is opened in a swing mode.

FIGS. 31 and 32 illustrate the vehicle door opening and closing apparatus according to exemplary embodiments of the present disclosure applied to the front door 4. FIG. 31 illustrates a state in which the front door 4 is opened in the sliding mode, and FIG. 32 illustrates a state in which the front door 4 is opened in the swing mode.

Figure 33:
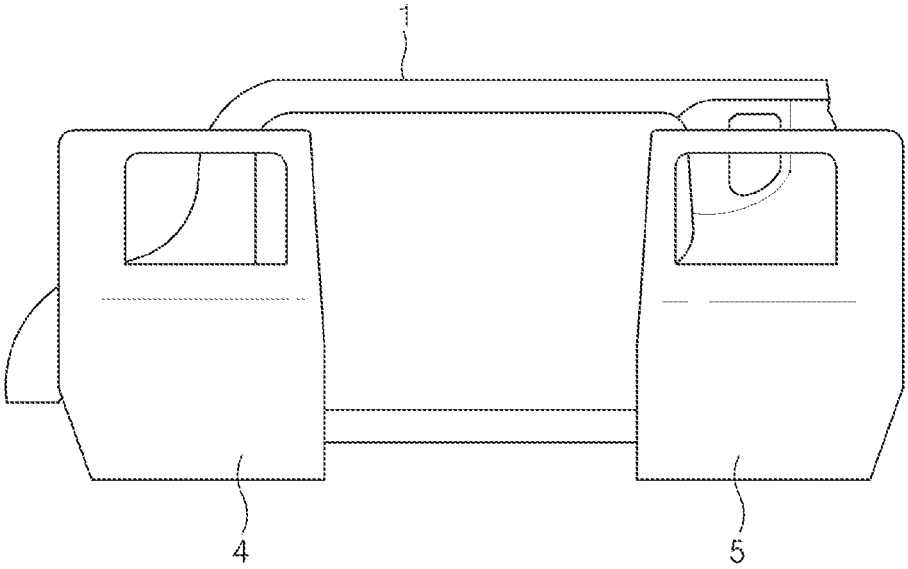
FIG. 33 illustrates a vehicle door opening and closing apparatus according to an exemplary embodiment of the present disclosure, which is applied to a front door and a rear door of a vehicle, in a state in which the front door and the rear door are opened in a sliding mode.
Figure 34:
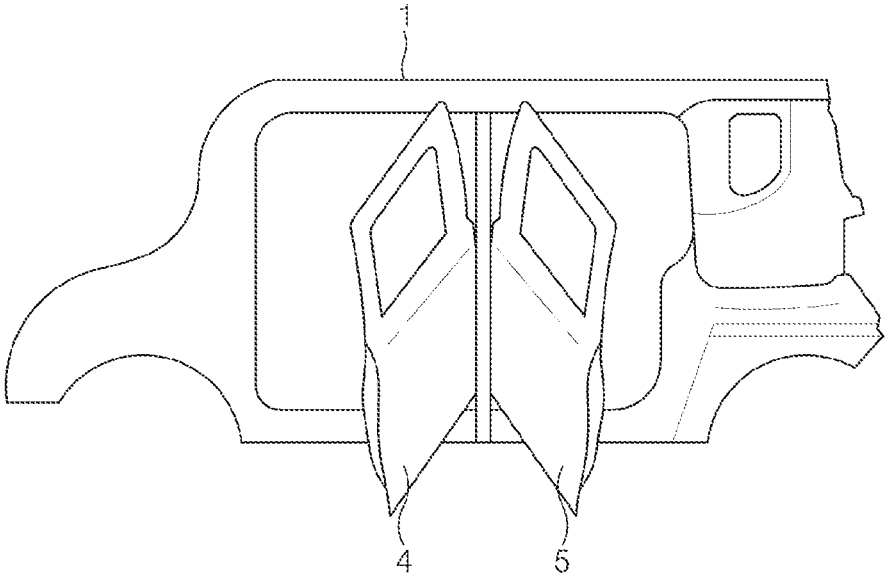
FIG. 34 illustrates a state in which the front door and the rear door of FIG. 33 are opened in a swing mode.

FIGS. 33 and 34 illustrate the vehicle door opening and closing apparatus according to exemplary embodiments of the present disclosure applied to both the front door 4 and the rear door 5. FIG. 33 illustrates a state in which the front door 4 and the rear door 5 are opened in the sliding mode, and FIG. 34 illustrates a state in which the front door 4 and the rear door 5 are opened in the swing mode.

As set forth above, the vehicle door opening and closing apparatus according to exemplary embodiments of the present disclosure may perform the opening and closing operations of the vehicle door by selectively switching the sliding mode and the swing mode, thereby meeting the needs of customers such as convenience and diversity. In addition, it may select the opening and closing operations of the vehicle door by taking the customer's situation and environment into consideration, thereby improving convenience and quality.

In particular, according to exemplary embodiments of the present disclosure, the door-side hinge element and the roller-side hinge element of the center roller unit may be released from each other when the vehicle door is opened and closed in the swing mode, and the door-side hinge element and the roller-side hinge element of the center roller unit may be connected to each other when the vehicle door is opened and closed in the sliding mode. Thus, the vehicle door may be reliably opened and closed in either the swing mode or the sliding mode.

In terms of vehicle specifications, the vehicle door opening and closing structure may be standardized, regardless of vehicle models. Thus, the manufacturing cost and investment cost may be significantly reduced.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A vehicle comprising:

a vehicle body having a door frame defining a door aperture;

a vehicle door;

a rail mounted on the vehicle body;

a roller unit mounted on the vehicle door and configured to move along the rail and allow the vehicle door to open and close in a sliding mode and a swing mode;

a center rail extending from an edge of the door aperture; and a center roller unit including rollers configured to be guided along the center rail, a roller bracket having the rollers mounted thereon, a roller-side hinge element connected to the roller bracket, and a door-side hinge element rotatably connected to the roller-side hinge element, wherein the roller-side hinge element and the door-side hinge element are releasably connected, wherein the roller-side hinge element is configured to be releasably connected to the door frame by a grip unit.

2. The vehicle according to claim 1, wherein:

the grip unit includes a housing fixed to the door frame, a first grip member pivotally mounted on the housing, and a second grip member pivotally mounted on the housing; and the first grip member and the second grip member are spaced apart from each other and arranged to face each other.

3. The vehicle according to claim 2, wherein:

the first grip member is biased toward a center of the housing by a first biasing element; and the second grip member is biased toward the center of the housing by a second biasing element.

4. The vehicle according to claim 1, wherein:

the grip unit includes a housing fixed to the door frame, a first grip member slidably mounted on the housing, and a second grip member slidably mounted on the housing; and the first grip member and the second grip member are spaced apart from each other and arranged to face each other.

5. The vehicle according to claim 4, wherein:

the first grip member is biased toward a center of the housing by a first biasing element; and the second grip member is biased toward the center of the housing by a second biasing element.

6. The vehicle according to claim 1, wherein:

the grip unit includes a housing fixed to the door frame, a first grip member fixedly mounted on the housing, and a second grip member fixedly mounted on the housing;

the first grip member and the second grip member are spaced apart from each other and arranged to face each other; and the first grip member and the second grip member elastically press the roller-side hinge element.

7. The vehicle according to claim 6, wherein:
the first grip member has a first closed cavity therein; and
the second grip member has a second closed cavity therein.

8. The vehicle according to claim 1, wherein:
the roller-side hinge element and the door-side hinge element are releasably connected by a slide hinge;
the roller-side hinge element has a roller-side hinge hole;
the door-side hinge element has a door-side hinge hole aligned with the roller-side hinge hole; and
the slide hinge is configured to move along an axis of the roller-side hinge hole and an axis of the door-side hinge hole.

9. The vehicle according to claim 8, wherein the slide hinge includes a base configured to move along the axis of the roller-side hinge hole and the axis of the door-side hinge hole, an extension portion extending from the base toward the door-side hinge element and the roller-side hinge element, and a hinge pin extending from the extension portion toward the axis of the roller-side hinge hole and the axis of the door-side hinge hole.

10. The vehicle according to claim 9, wherein the hinge pin is releasably inserted into the roller-side hinge hole and the door-side hinge hole by a movement of the base.

11. The vehicle according to claim 10, wherein the base is configured to be moved by a driving unit between a connection position in which the door-side hinge element and the roller-side hinge element are connected to each other and a release position in which the door-side hinge element and the roller-side hinge element are released from each other.

12. The vehicle according to claim 11, wherein:
the driving unit includes a driving motor, a pinion coupled to a driving shaft of the driving motor, and rack teeth configured to mesh with the pinion; and
the rack teeth are arranged in a longitudinal direction of the base.

13. The vehicle according to claim 9, wherein:
the grip unit includes a housing fixed to the door frame, a first grip member slidably mounted on the housing, and a second grip member slidably mounted on the housing; and
the first grip member and the second grip member are spaced apart from each other and arranged to face each other.

14. The vehicle according to claim 1, wherein:
the roller-side hinge element has a hinge pin;
the door-side hinge element has a first recess configured to receive a first portion of the hinge pin;
the door-side hinge element includes a hinge lug configured to move along a circumference of the first recess;
the hinge lug has a second recess configured to receive a second portion of the hinge pin; and
the first recess and the second recess selectively define a closed hinge hole or an open hinge hole by a movement of the hinge lug.

15. The vehicle according to claim 14, wherein the hinge lug is configured to move between a hold position in which the hinge lug holds the hinge pin and a release position in which the hinge lug allows the hinge pin to be released.

16. The vehicle according to claim 15, wherein:
the first recess and the second recess define the closed hinge hole allowing the hinge pin to be held when the hinge lug is in the hold position; and
the first recess and the second recess define the open hinge hole allowing the hinge pin to be released when the hinge lug is in the release position.

17. A vehicle door opening and closing apparatus comprising:
a rail configured to be mounted on a vehicle body having a door frame defining a door aperture;
a roller unit configured to be mounted on the vehicle door, to move along the rail, and to allow the vehicle door to open and close in a sliding mode and a swing mode;
a center rail configured to extend from an edge of the door aperture; and
a center roller unit including:
rollers configured to be guided along the center rail and to be mounted on a roller bracket;
a roller-side hinge element configured to be connected to the roller bracket; and
a door-side hinge element configured to be rotatably connected to the roller-side hinge element,
wherein the roller-side hinge element and the door-side hinge element are configured to be releasably connected, and
wherein the roller-side hinge element is configured to be releasably connected to the door frame by a grip unit.

18. The apparatus according to claim 17, wherein:
the grip unit includes a housing configured to be fixed to the door frame, a first grip member configured to be pivotally mounted on the housing, and a second grip member configured to be pivotally mounted on the housing;
the first grip member and the second grip member are configured to be spaced apart from each other and arranged to face each other;
the first grip member is configured to be biased toward a center of the housing by a first biasing element; and
the second grip member is configured to be biased toward the center of the housing by a second biasing element.

19. The apparatus according to claim 17, wherein:
the grip unit includes a housing configured to be fixed to the door frame, a first grip member configured to be slidably mounted on the housing, and a second grip member configured to be slidably mounted on the housing;
the first grip member and the second grip member are configured to be spaced apart from each other and arranged to face each other;
the first grip member is configured to be biased toward a center of the housing by a first biasing element; and
the second grip member is configured to be biased toward the center of the housing by a second biasing element.

20. A vehicle door opening and closing apparatus comprising:
a rail configured to be mounted on a vehicle body having a door frame defining a door aperture;
a roller unit configured to be mounted on the vehicle door, to move along the rail, and to allow the vehicle door to open and close in a sliding mode and a swing mode;
a center rail configured to extend from an edge of the door aperture; and
a center roller unit including
rollers configured to be guided along the center rail and to be mounted on a roller bracket;
a roller-side hinge element configured to be connected to the roller bracket, the roller-side hinge element having a roller-side hinge hole; and
a door-side hinge element configured to be rotatably connected to the roller-side hinge element, the door-side hinge element having a door-side hinge hole configured to be aligned with the roller-side hinge hole;

wherein the roller-side hinge element and the door-side hinge element are configured to be releasably connected by a slide hinge; and wherein the slide hinge is configured to move along an axis of the roller-side hinge hole and an axis of the door-side hinge hole.

* * * * *